US006045984A

United States Patent [19]

Hoshino

[11] Patent Number: 6,045,984

[45] Date of Patent: Apr. 4, 2000

[54] SILVER HALIDE LIGHT SENSITIVE PHOTOGRAPHIC MATERIAL

[75] Inventor: Hiromi Hoshino, Hino, Japan

[73] Assignee: Konica Corporation, Japan

[21] Appl. No.: 09/082,337

[22] Filed: May 20, 1998

[30] Foreign Application Priority Data

May 23, 1997 [JP] Japan ..... 9-133538

[51] Int. Cl.[7] ..... G03C 1/035; G03C 1/35; G03C 1/40; G03C 5/16

[52] U.S. Cl. ..... 430/504; 430/558; 430/559; 430/567; 430/966

[58] Field of Search ..... 430/567, 504, 430/558, 559, 966

[56] References Cited

U.S. PATENT DOCUMENTS

| | | | |
|---|---|---|---|
| 4,435,501 | 3/1984 | Maskasky | 430/434 |
| 4,865,958 | 9/1989 | Abbott et al. | 430/542 |
| 5,707,792 | 1/1998 | Yamada et al. | 430/561 |
| 5,874,206 | 2/1999 | Kimura et al. | 430/565 |

FOREIGN PATENT DOCUMENTS

| | | | |
|---|---|---|---|
| 0468211 | 1/1992 | European Pat. Off. | G03C 1/83 |
| 0699944 | 3/1996 | European Pat. Off. | G03C 1/005 |
| 0845706 | 6/1998 | European Pat. Off. | G03C 8/40 |
| 03/153234 | 7/1991 | Japan | G03C 1/047 |

OTHER PUBLICATIONS

European Search Report EP 98 10 9221.

EPO Patent Abstracts of Japan Publication #03153234.

*Primary Examiner*—Mark F. Huff

*Attorney, Agent, or Firm*—Jordan B. Bierman; Bierman, Muserlian and Lucas

[57] ABSTRACT

A silver halide light sensitive photographic material is disclosed, comprising component layers including a silver halide emulsion layer and a hydrophilic colloid layer, wherein the silver halide emulsion layer comprises tabular grains and at least one of the component layers layers contains a leuco compound capable of forming a dye upon reaction with an oxidation product of a developing agent; the tabular grains 1) having (111) major faces, and exhibiting an average equivalent circular diameter of 0.5 to 3.0 $\mu$m and an average thickness of 0.07 to 0.3 $\mu$m, 2) including epitaxially deposited silver halide protrusions of a face-centered cubic crystal lattice structure forming epitaxial junctions with the tabular grains, and 3) the protrusion being located on peripheral portions of the tabular grains.

8 Claims, No Drawings

SILVER HALIDE LIGHT SENSITIVE PHOTOGRAPHIC MATERIAL

FIELD OF THE INVENTION

The present invention relates to a silver halide light sensitive photographic material (hereinafter, also referred to as photographic material) and in particular to a photographic material capable of forming images exhobiting improved silver image tone and superior sharpness.

BACKGROUND OF THE INVENTION

Recently, along with development of medical techniques, high sensitivity, high image quality and high-speed processing for reducing stress on patients and improving handling are desired in X-ray photographic materials for use in medical diagnosis. To achieve rapid processing, in particular, further enhancement of developability and drying speed is desired.

In response to these requirements are proposed a variety of techniques for rapid access. In photographic materials, for example, is a technique of using tabular silver halide grains, whereby covering power, spectral sensitivity, sharpness and graininess are known to be enhanced. Presumably due to the shape of the tabular grains, on the other hand, fine filaments of developed silver are easily extended to form yellowish silver images, which reduce accuracy of diagnosis.

There is known, as means for improving silver image tone, enhanced hardening of the photographic material, which, however, adversely affects developability and fixability in rapid processing. There is also known a means for improving silver image tone by allowing a compound such as 1-phenyl-5-mercaptotetrazole to be incorporated into a silver halide emulsion layer. However, this causes disadvantageous lowering of the sensitivity. Further, JP-A 3-153234 (hereinafter, the term "JP-A" refers to unexamined and published Japanese Patent Application) discloses the use of a leuco dye, which forms imagewise a blue dye in proportion to developed silver. This technique, however, was proved to be insufficient in blue color formation. Specifically in the case of rapid access, in which the total processing time from development to drying is 30 sec. or less, blue color formation was insufficient and silver image tone was not improved to acceptable practical level. Accordingly, there is desired a photographic material with superior sharpness and improved silver image tone, even when subjected to rapid processing.

SUMMARY OF THE INVENTION

It is an object of the present invention to provide a photographic material with superior sharpness and improved silver image tone, even when subjected to rapid processing.

To solve the above problem, the inventor of the present invention found that the following means is effective:

A silver halide light sensitive photographic material comprising a support having thereon photographic component layers including a silver halide emulsion layer and a hydrophilic colloid layer, wherein the silver halide emulsion layer comprises tabular silver halide grains satisfying the following requirements 1), 2) and 3), and at least one of the component layers containing a leuco compound capable of forming a dye upon reaction with an oxidation product of a developing agent:

1) the tabular grains having (111) major faces and exhibiting an average equivalent circular diameter of 0.5 to 3.0 μm and an average thickness of 0.07 to 0.3 μm;
2) the tabular grains including silver halide protrusions epitaxially deposited and having a face-centered cubic crystal lattice structure forming epitaxial junctions with tabular host grains, and
3) the protrusion being located at least on peripheral portions of the tabular host grains.

DETAILED DESCRIPTION OF THE INVENTION

The tabular silver halide host grains used in the invention are those conventionally employed. The silver halide grains according to the invention can be prepared by preparing the tabular silver halide host grains, followed by epitaxy growth (i.e. forming protrusions epitaxially deposited on the tabular host grains). Hereinafter, silver halide grains prepared at the time of the tabular silver halide host grains being, refers to tabular host grains.

The tabular host grains according to the invention preferably comprise silver bromide, silver iodobromide, silver chlorobromide or silver iodochlorobromide. In cases where the iodide is contained, the iodide content is preferably 0.1 to 10 mol %, more preferably 0.2 to 6 mol % and still more preferably 0.4 to 2 mol %, based on silver. The tabular silver halide grains may contain a small amount of chloride, for example, U.S. Pat. No. 5,372,927 describes tabular silver chlorobromide grains containing 0.4 to 20 mol % chloride.

The tabular silver halide grains according to the invention each have two opposed parallel (111) major faces. An average equivalent circular diameter of the tabular grains is preferably 0.5 to 3.0 μm, and more preferably 0.5 to 2.0 μm. The grain thickness is preferably 0.07 to 0.3 μm, and more preferably 0.1 to 0.3 μm. Herein, the equivalent circular diameter means the diameter of the projected area (hereinafter referred to as a grain diameter), which is expressed as the diameter of a circle equivalent to the projected area of the tabular silver halide grain (i.e. the diameter of a circle having an area identical to the grain projected area). The grain thickness is the distance between parallel major faces of the tabular silver halide grain.

The tabular silver halide grains according to the invention preferably are monodisperse emulsion grains having a narrow grain size distribution, and specifically having a grain diameter distribution width, as defined below, of preferably not more than 25%, more preferably not more than 20%, and still more preferably not more than 15%:

(standard deviation of grain diameter/average grain diameter)×100=distribution width of grain diameter.

The tabular silver halide grains according to the invention preferably are those having a narrow grain thickness distribution, and specifically having a grain thickness distribution width, as defined below, of preferably not more than 25%, more preferably not more than 20%, and still more preferably not more than 15%:

(standard deviation of grain thickness/average grain thickness)×100=distribution width of grain thickness.

The tabular silver halide grains are crystallographically classified as a twinned crystal. The twinned crystal is a silver halide crystal having one or more twinned planes within the grain. Classification of shapes of the twinned crystal is detailed in Klein and Moisar, Photographisch Korrepondenz Vol. 99, page 99 and vol. 100, page 57.

In the tabular silver halide grains, silver halide protrusions are formed at least on peripheral portions of the tabular host grains. The peripheral portion of the tabular host grain refers to the region surrounded by the periphery of the major face of the tabular grain and the line formed by a set of dots having a distance from the periphery of 10% of the equivalent circular diameter of the tabular grain.

The silver halide protrusion in the invention preferably comprises silver bromide, silver iodobromide, silver chlorobromide or silver iodochlorobromide. In cases where the iodide is contained, the iodide content is preferably 0.1 to 13 mol %, and more preferably 0.1 to 10 mol %.

To allow the silver halide protrusions to be deposited on the tabular host grains, halide ions are introduced there, and in cases where plural kinds of the halide ions are introduced, it is preferred to add them in the order of the higher solubility of its silver salt. Solubility of silver iodide is lower than that of silver bromide and the solubility of silver bromide is lower than that of silver chloride, so that, if the halide ions are added in the preferred order, the chloride ions are most probable to be deposited in the vicinity of the epitaxial junctions. There are cases that the protrusions form well-defined layers, and the region with a higher chloride concentration and one with a lower chloride concentration are easily distinguished; and when not added in the preferred order, there are cases in which both regions can not be definitely detected because bromide and iodide ions have the capability of replacing the chloride previously deposited.

According to the present invention, the silver halide protrusions are localized in portions nearest the periphery of the tabular host grains and preferably accounting for less than 50% of the (111) major faces of the tabular grains, more preferably less than 25% thereof, still more preferably less than 10% thereof, and optimally less than 5% thereof.

In cases where the tabular grains contain a central region with a lower iodide concentration and a region with a higher iodide concentration located in side-portions, the silver halide protrusions are preferably localized in the region containing the edge and the corner of the tabular grains.

In one embodiment of the invention, a given amount of the silver halide protrusions is effective. In general, the concentration of the silver halide protrusions is preferably 0.3 to 25 mol %, based on total silver and the concentration of 0.5 to 15 mol % is further preferred in terms of optimal sensitization.

When the halide ions are introduced, the temperature of the emulsion containing the tabular grains is preferable in the range of 35 to 70° C., while the pAg is preferably in the range of 6.0 to 8.5, and the pH is preferably 4 to 9.

When the silver halide protrusions are formed in the peripheral portions of the tabular host grains, it is preferred to add, prior to introduction of the halide ions, a compound acting as a site-director in epitaxially depositing the silver halide protrusions (hereinafter, referred to as a site-director). Unless the site-director is added, the silver halide protrusions tend to deposit not only in the peripheral portions of the tabular grains but also in the overall major faces.

The site-director preferably used in the invention is any one of the compounds known in the art as a spectral sensitizing dye of silver halide grains. Examples thereof include cyanine, merocyanine, complex cyanine, complex merocyanine, holo-polar cyanine, hemi-cyanine, styryl and hemi-oxanol dyes, and of these are preferred compounds capable of forming a J-aggregate with silver halide. Specifically preferred are green or red absorbing cyanine dyes. Further, as an inorganic site-director compound are employed an iodide, thiocyanide and selenocyanide.

When the site-director is introduced, the temperature of the emulsion containing the tabular grains is preferable in the range of 35 to 70° C., and more preferably 35 to 60° C., while the pAg of the emulsion containing the tabular grains is preferably in the range of 6.0 to 8.5, and the pH is preferably from 4 to 9.

Silver halide grains relating to the invention may contain dislocations. The dislocation can be directly observed by the method using a transmission electron microscope at a low temperature, as described in J. F. Hamilton, Phot. Sci. Eng., 57 (1967) and T. Shiozawa, J. Soc. Phot. Sci. Japan, 35, 213 (1972). More concretely, silver halide grains which were carefully taken out of the emulsion so as not to apply pressure to produce dislocations within the grain, are put on a mesh for use in electron microscopic observation and observed by the transmission method, while cooling a sample to prevent occurrence of damage with the electron beam (e.g. print-out). In this case, the higher the grain thickness, the more difficult transmission of the electron beam becomes r, so that sharp images can be obtained by using a high pressure type electron microscope (e.g. 200 kV or more at a grain thickness of 0.25 $\mu$m).

The tabular silver halide grains relating to the invention may contain, in the interior or exterior of the grain, ions of a metal selected from a cadmium salt, zinc salt, lead salt, thallium salt, iridium salt (including its complex salt), rhodium salt (including its complex salt), and iron salt (including its complex salt), which is added at a time during the course of nucleation and growth.

Next, the leuco compound according to the invention is detailed.

The leuco compound capable of forming dye upon reaction with an oxidation product of a developing agent in a developing solution is contained in at least one of the hydrophilic colloid layers, the leuco compound being represented by the following formula.

Formula (1)

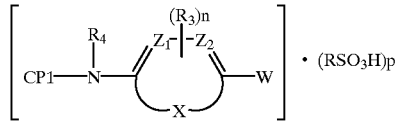

In the formula, W is —$NR_1R_2$, —OH or —OZ, in which $R_1$ and $R_2$ each are an alkyl group or an aryl group and Z is an alkali metal ion or a quaternary ammonium ion. n is an integer of 1 to 3; and $R_3$ is a hydrogen atom, a halogen atom or a univalent substituent. $Z_1$ and $Z_2$ each are a nitrogen atom or =C($R_3$)—. X is an atomic group necessary for forming a 5- or 6-membered aromatic heterocyclic ring with $Z_1$, $Z_2$ and carbon atoms adjoining thereto. $R_4$ is a hydrogen atom, an acyl group, a sulfonyl group, carbamoyl group, sulfo group, sulfamoyl group, an alkoxycarbonyl group, or aryoxycarbonyl group. R is an aliphatic group or an aromatic group. p is an integer of 0, 1 or 2. CP1 is the following groups:

CP1

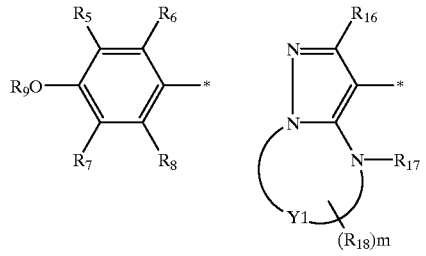

-continued

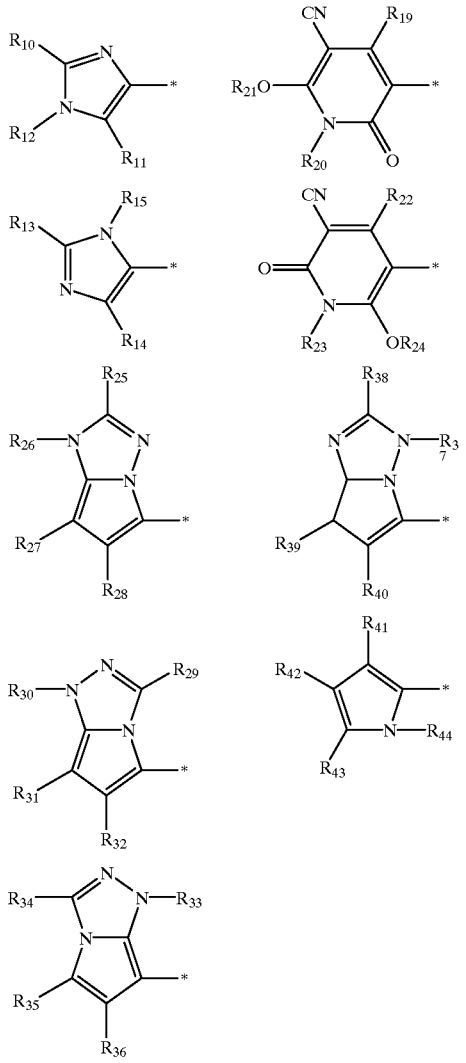

In the formula, $R_5$ through $R_8$ each are a hydrogen atom, a halogen atom or a substituent for a benzene ring, provided that $R_5$ and $R_{61}$ or $R_7$ and $R_8$ may be linked with each other to form a 5 to 7-membered ring. $R_9$ has the same definition as $R_4$. $R_{10}$ and $R_{11}$ each are an alkyl group, an aryl group or a heterocyclic group. $R_{12}$ has the same definition as $R_4$. $R_{13}$ and $R_{14}$ each have the same definition of $R_{10}$ and $R_{11}$. $R_15$ has the same definition as $R_{12}$. $R_{16}$ is an alkyl group, an aryl group, a sulfonyl group, a trifluoromethyl group, a carboxy group, an aryloxycarbonyl group, an alkoxycarbonyl group, a carbamoyl group or a cyano group. $R_{17}$ has the same definition as $R_4$. $R_{18}$ has the same definition as $R_3$ and m is an integer of 1 to 3. Y1 is an atomic group necessary for forming 5- or 6-membered nitrogen containing monocyclic or condensed ring together with two nitrogen atoms. $R_{19}$ and $R_{20}$ each are an alkyl group or an aryl group. $R_{21}$ has the same definition as $R_4$. $R_{22}$ and $R_{23}$ each have the same definition as $R_{19}$ and $R_{20}$. $R_{24}$ has the same definition as $R_{21}$. $R_{25}$ , $R_{27}$ and $R_{28}$ each are a hydrogen atom or a substituent. $R_{26}$ has the same definition as $R_4$. $R_{29}$, $R_{31}$ and $R_{32}$ each have the same definition as $R_{25}$ $R_{27}$ and $R_{28}6$ $R_{30}$ has the same definition as $R_{26}$. $R_{34}$, $R_{35}$ and $R_36$ each have the same definition $R_{25}$, $R_{27}$ and $R_{28}$ . $R_{33}$ has the same definition as $R_{26}$ $R_{38}$, $R_{39}$ and $R_{40}$ each have the same definition as $R_{25}$, $R_{27}$ and $R_{28}$ $R_{37}$ has the same definition as $R_{26}$. $R_{411}$ $R_{42}$ and $R_{43}$ each have the same definition as $R_{25}$, $R_{27}$ and $R_{28}$.$R_{44}$ has the same definition as $R_{26}$. The symbol, "★" represents a bonding site of CP1 with the other moiety.

Of the leuco compounds represented by formula (1) is preferred a compound represented by the following formula (2).

Formula (2)

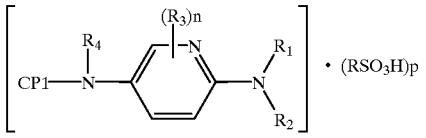

In the formula, CP1, $R_1$, $R_2$, $R_3$ and $R_4$ are each the same as defined in formula (1). R, n and p are each also the same as defined in formula (1).

In formula (1) or (2), an alkyl group represented by $R_1$ and $R_2$ preferably includes a methyl group, ethyl group, propyl group and butyl group, which may be substituted. Preferred examples of the substituent include hydroxy group and sulfonamido group.

An aryl group represented by $R_1$ and $R_2$ preferably includes a phenyl group.

The univalent substituent represented by $R_3$ includes an alkyl group (e.g., methyl, ethyl, isopropyl, hydroxyethyl, methoxyethyl, trifluoromethyl, t-butyl, etc.), cycloalkyl group (e.g., cyclopentyl, cyclohexyl, etc.), aralkyl group (e.g., benzyl, 2-phenethyl, etc.), aryl group (e.g., phenyl, naphthyl, p-tolyl, p-chlorophenyl, etc.), alkoxy group (e.g., methoxy, ethoxy, isopropoxy, n-butoxy, etc.), aryloxy group (e.g., phenoxy, etc.), cyano group, acylamino group (e.g., acetylamino, propionylamino, etc.), alkylthio group (e.g., methylthio, ethylthio, n-butylthio, etc.), arylthio group (e.g., phenylthio etc.), sulfonylamino group (e.g., methanesulfonylamino, benzenesulfonylamino, etc.), ureido group (e.g., 3-methylureido, 3,3-dimethylureido, 1,3-dimethylureido, etc.), sulfamoylamino group (e.g., dimethylsulfamoylamino, etc.), carbamoyl group (e.g., methylcarbamoyl, ethylcarbamoyl, dimethylcarbamoyl, etc.), sulfamoyl group (e.g., ethylsulfamoyl, dimethylsulfamoyl, etc.), alkoxycarbonyl group (e.g., methoxycarbonyl, ethoxycarbonyl, etc.), aryloxycarbonyl group (e.g., pheoxycarbonyl, etc.), sulfonyl group (e.g., methanesulfonyl, butanesulfonyl, phenylsulfonyl, etc.), acyl group (e.g., acetyl, propanoyl, butyloyl, etc.), amino group (e.g., methylamino, ethylamino, dimethylamino, etc.), hydroxy group, nitro group, imido group (e.g., phthalimido, etc.), and heterocyclic group (e.g., pyridyl, benzimidazolyl, benzthiazolyl, benzoxazolyl, etc.).

Regarding $R_4$, the acyl group preferably includes an acetyl group, trifluoroacetyl group and benzoyl group. The sulfonyl group preferably includes a methanesulfonyl group and benzenesulfonyl group. The carbamoyl group preferably includes a diethylcarbamoyl group and phenyl carbamoyl group. The sulfamoyl group preferably includes a diethylsulfamoyl group. The alkoxycarbonyl group preferably includes a methoxycarbonyl group and ethoxycarbonyl group. The aryoxycarbonyl group preferably includes a phenoxycarbonyl group.

Regarding Z, the alkali metal includes sodium and potassium. The quaternary ammonium is an ammonium having a total carbon atoms of 8 or less, including trimethylbenzylammonium, tetrabutylammonium and tetradecylammonium.

Examples of the 5- or 6-membered aromatic heterocyclic ring formed with X, Z1, $Z_2$ and carbon atoms adjoining thereto include a pyridine ring, pyridazine ring, pyrazine ring, triazine ring, tetrazine ring, pyrrol ring, furan ring, thiophene ring, thiazole ring, oxazole ring, imidazole ring, thiadiazole ring, and oxadiazole ring. Among these, the pyridine ring is preferred.

As the substituents for a benzene ring represented by $R_5$ through $R_8$ are cited the same as those of the univalent substituent represented by $R_3$. Of these are preferred an alkyl group and acylamino group. The 5- to 7-membered ring formed by a combination of $R_5$ and $R_6$, or $R_7$ and Ra includes an aromatic hydrocarbon ring and heterocyclic ring, preferably, benzene ring.

Regarding $R_{10}$ and $R_{11}$, examples of the alkyl group include methyl, ethyl, propyl and butyl. Examples of the aryl group include a phenyl group and naphthyl group. As the heterocyclic group is cited an aromatic heterocyclic ring containing at least one of O, S and N (e.g., 6-membered azine ring, such as pyridine, pyrazine and pyrimidine, and its benzelogue; pyrrol, thiophene and furan, and their benzelogue; 5-membered azole ring, such as imidazole, pyrazole, triazole, tetrazole, thiazole, oxazole, thiadiazole and oxadiazole, and its benzelogue. $R_{10}$and $R_{11}$ are preferably a phenyl group, pyrazolyl group and pyridyl group.

Regarding $R_{16}$, examples of the alkyl group include a methyl group, isopropyl group, pentyl group and t-butyl group. The aryl group includes a phenyl group, naphthyl group and so forth. The sulfonyl group includes a methanesulfonyl group, benzenesulfonyl group and so forth. The aryloxycarbonyl group includes a phenoxycarbonyl group and so forth. The alkoxycarbonyl group includes an ethoxycarbonyl group and so forth. The carbamoyl group includes a diethylaminocarbamoyl group and so forth.

Examples of the nitrogen-containing heterocyclic ring represented by Y1 include imidazole, triazole and tetrazole rings and their benzo-condensed rings.

Regarding $R_{19}$ and $R_{20}$, examples of the alkyl group include a methyl group, pentyl group, t-butyl group and so forth. examples of the aryl group include a phenyl group, naphthyl group and so forth.

The substituent represented by $T_{25}$, $R_{27}$ or $R_{28}$ includes a phenyl group, methyl group, benzoyl group, phenoxy group, ethoxy group and so forth.

Examples of the aliphatic group represented by R include a hexyl group, dodecyl group and so forth. The aromatic group includes p-toluene, dodecylbenzene, and so forth.

Exemplary Examples of the compounds represented formula (1) or (2) [including examples of CP1 moiety, residual moiety (denoted as CD), RSO3H, and compounds comprised thereof (No. 1 to 79)] are shown as below, but the invention is not limited thereto.

CP

CP-1

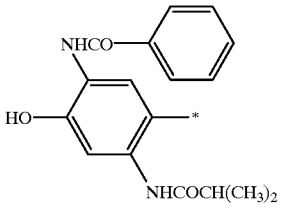

-continued

CP-2

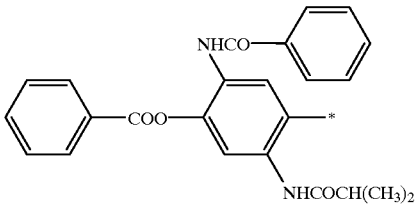

CP-3

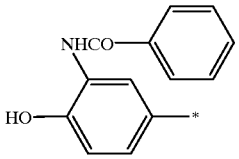

CP-4

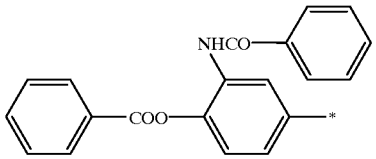

CP-5

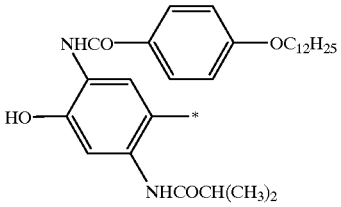

CP-6

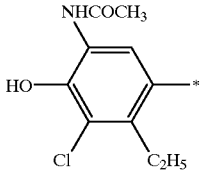

CP-7

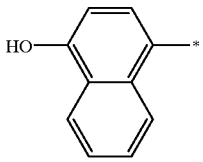

CP-8

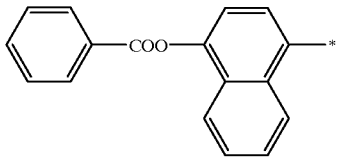

-continued
CP-9
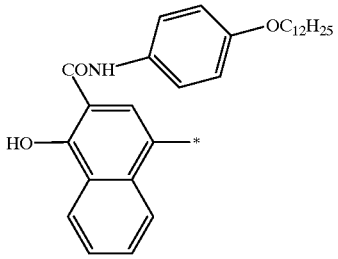
CP-10
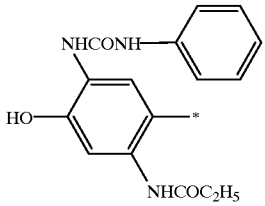
CP-11
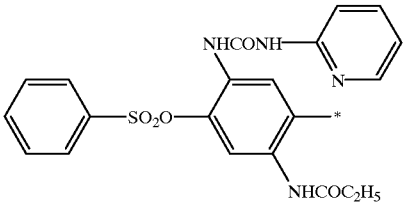
CP-12
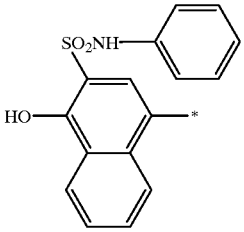
CP-13
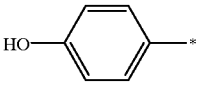
CP-14
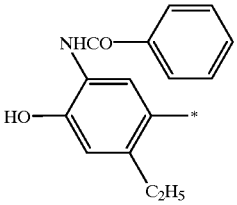
-continued
CP-15
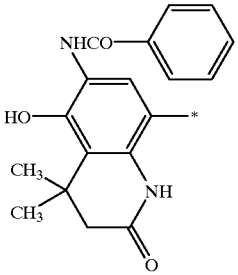
CP-16
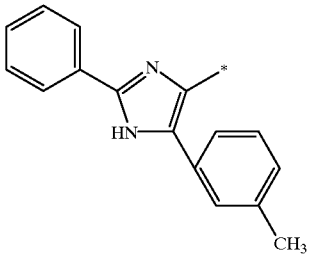
CP-17
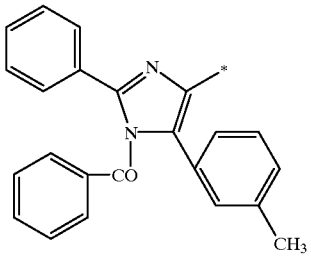
CP-18
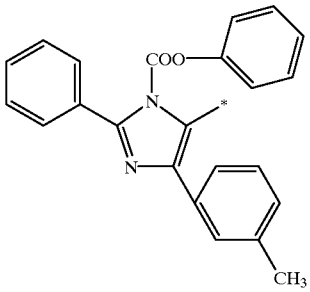
CP-19
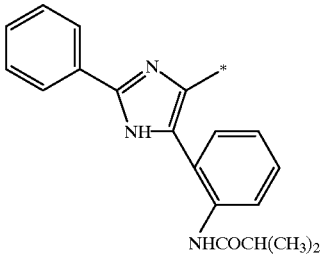

-continued
CP-20
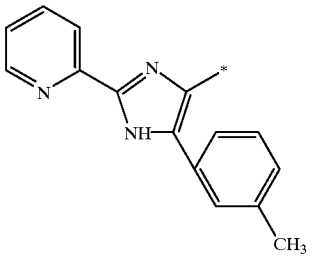
CP-21
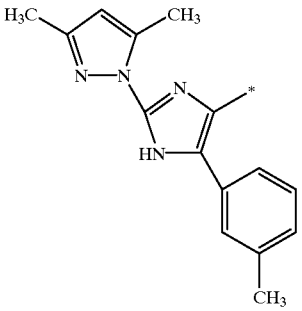
CP-22
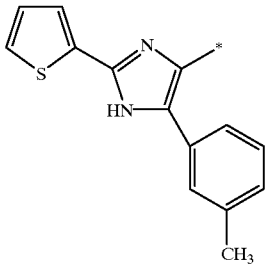
CP-23
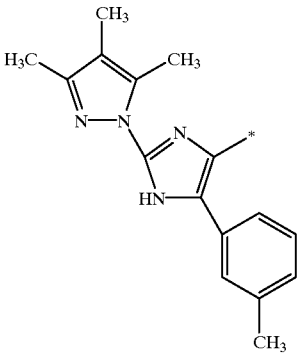
-continued
CP-24
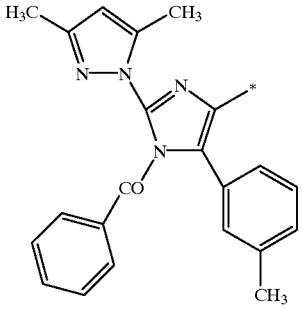
CP-25
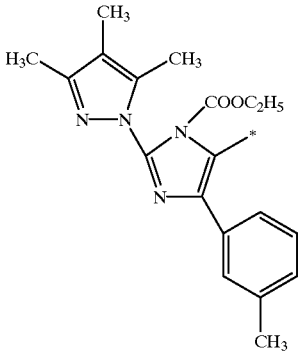
CP-26
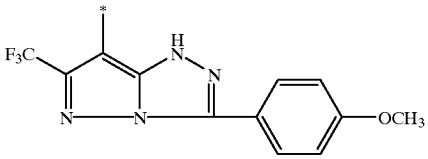
CP-27
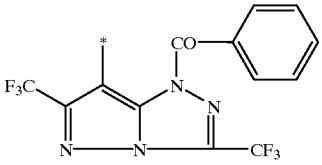
CP-28
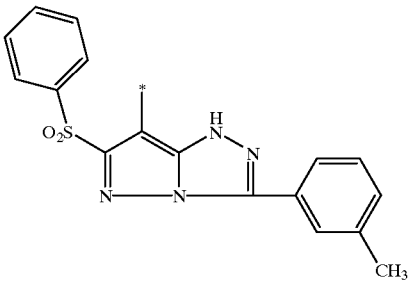

-continued
CP-29
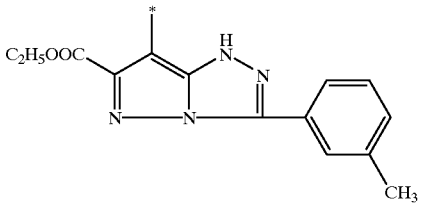
CP-30
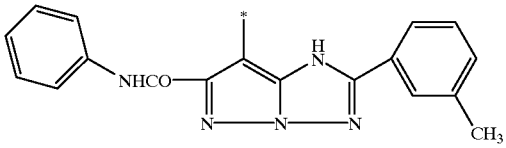
CP-31
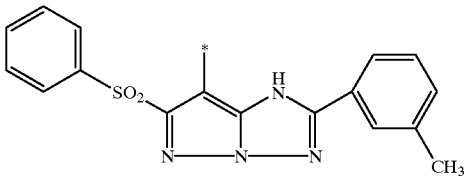
CP-32
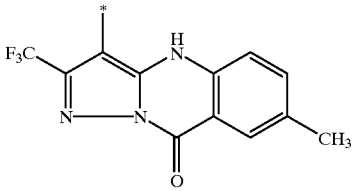
CP-33
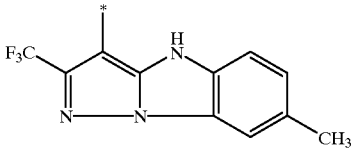
CP-34
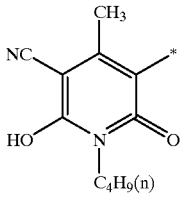
CP-35
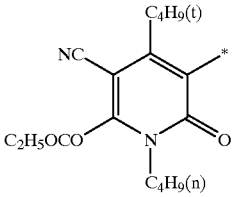
-continued
CP-36
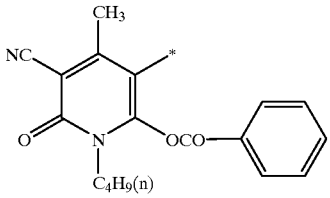
CP-37
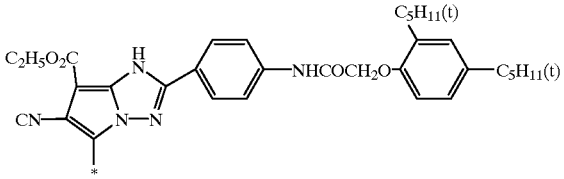
CP-38
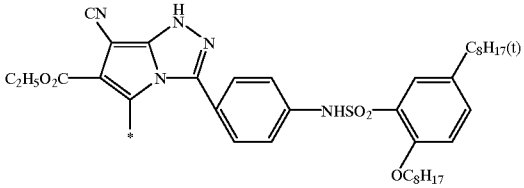
CP-39
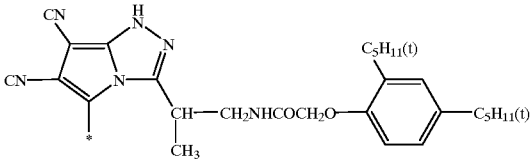
CP-40
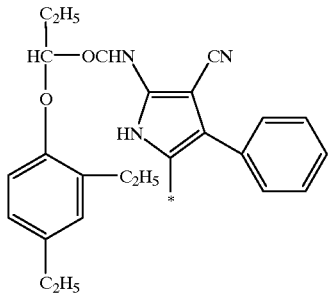
CP-41
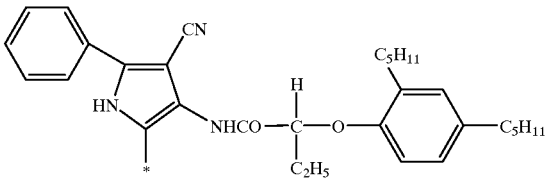

-continued
CP-42
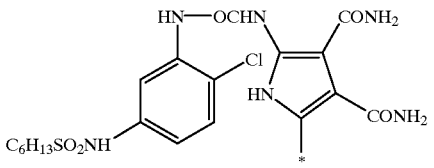
CP-43
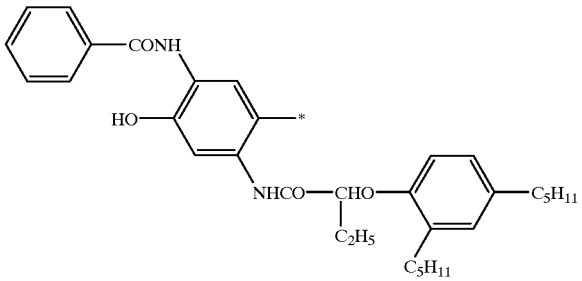
CP-44
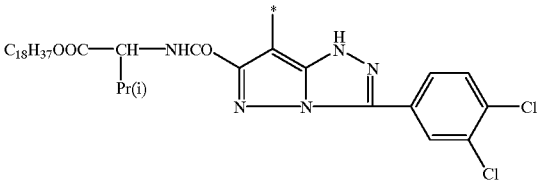
CD
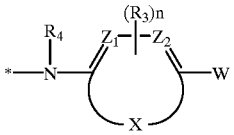
CD-1
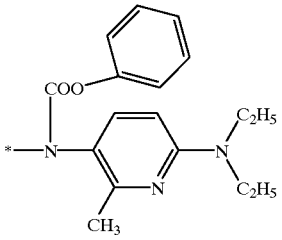
CD-2
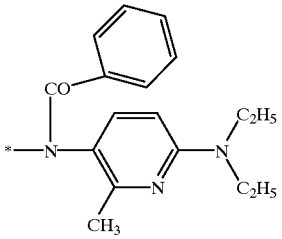
-continued
CD-3
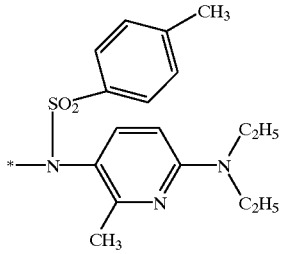
CD-4
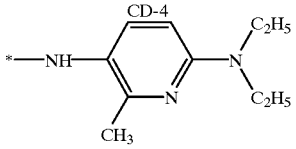
CD-5
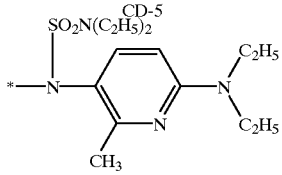
CD-6
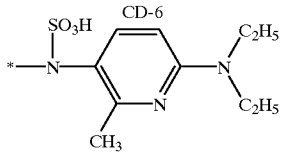
CD-7
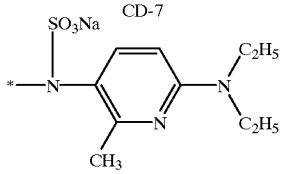
CD-8
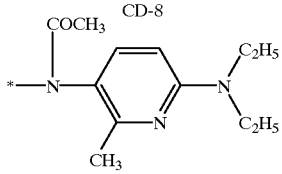
CD-9
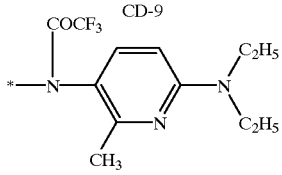
CD-10
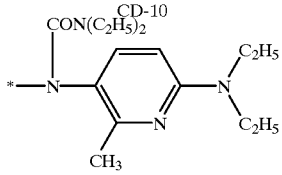

-continued
CD-11
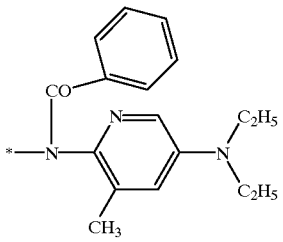
CD-12
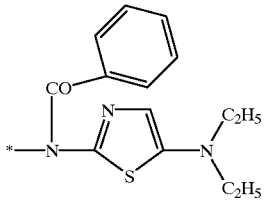
CD-13
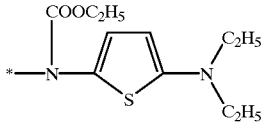
CD-14
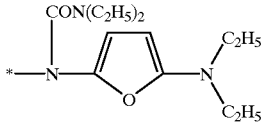
CD-15
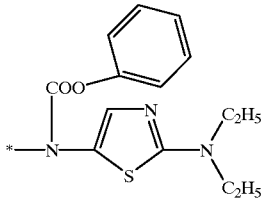
CD-16
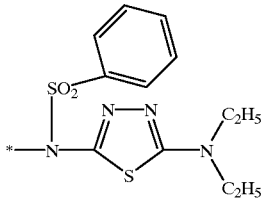
CD-17
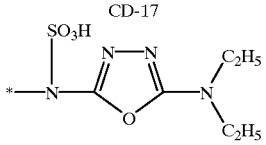
-continued
CD-18
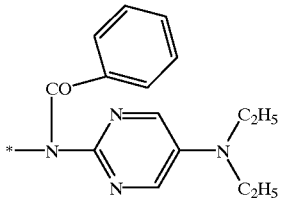
CD-19
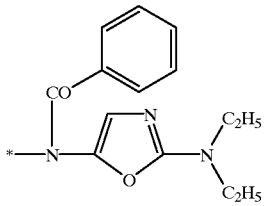
CD-20
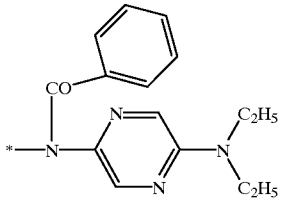
CD-21
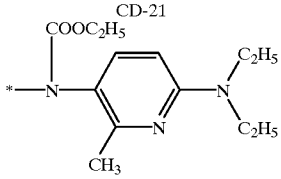
CD-22
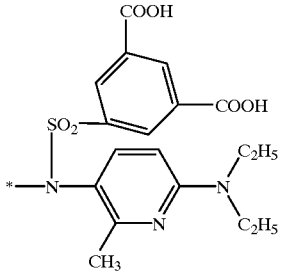
CD-23
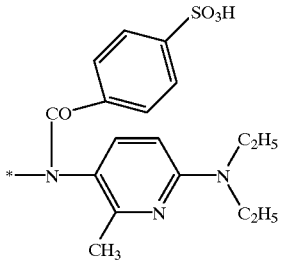

-continued
CD-24
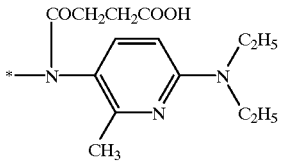
CD-25
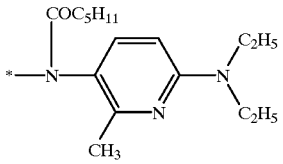
CD-26
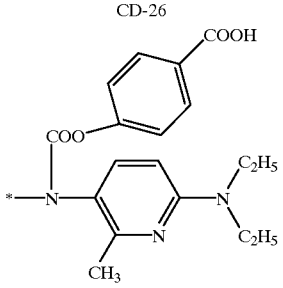
CD-27
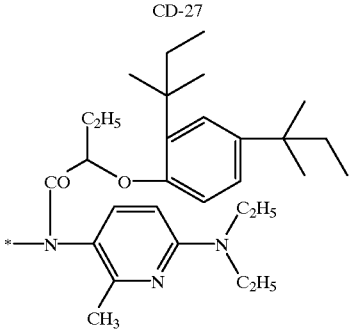
CD-28
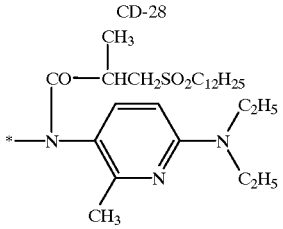
CD-29
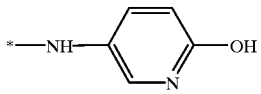
CD-30
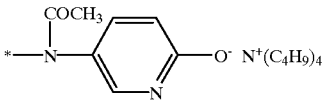
-continued
CD-31
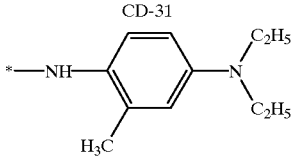
CD-32
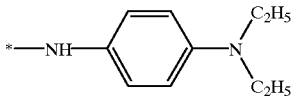
$RSO_3H$
a)
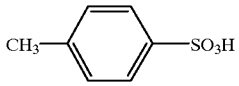
b)
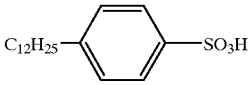
c)
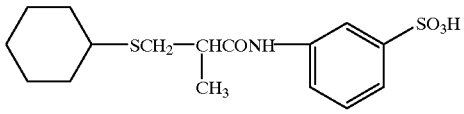
d)
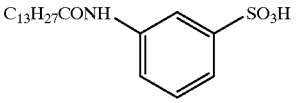
e)
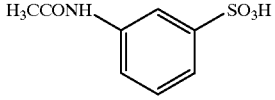
f)
| No. | CP | $C_{12}H_{25}SO_3H$ CD | $RSO_3H$ |
|---|---|---|---|
| 1 | 1 | 1 | |
| 2 | 1 | 2 | |
| 3 | 1 | 3 | |
| 4 | 1 | 4 | |
| 5 | 1 | 5 | |
| 6 | 1 | 6 | |
| 7 | 1 | 7 | |
| 8 | 1 | 8 | |
| 9 | 1 | 9 | |
| 10 | 1 | 10 | |
| 11 | 1 | 21 | |
| 12 | 1 | 25 | |
| 13 | 2 | 2 | |
| 14 | 2 | 7 | |
| 15 | 2 | 15 | |
| 16 | 2 | 20 | |
| 17 | 3 | 1 | |
| 18 | 3 | 2 | |
| 19 | 3 | 8 | |

-continued

| | | | |
|---|---|---|---|
| 20 | 4 | 16 | |
| 21 | 4 | 22 | |
| 22 | 5 | 1 | |
| 23 | 5 | 7 | |
| 24 | 5 | 11 | |
| 25 | 5 | 27 | |
| 26 | 7 | 1 | |
| 27 | 7 | 2 | |
| 28 | 8 | 9 | |
| 29 | 8 | 12 | |
| 30 | 16 | 2 | |
| 31 | 16 | 7 | |
| 32 | 17 | 10 | |
| 33 | 18 | 13 | |
| 34 | 21 | 1 | |
| 35 | 21 | 4 | |
| 36 | 21 | 7 | |
| 37 | 21 | 18 | |
| 38 | 26 | 2 | |
| 39 | 26 | 7 | |
| 40 | 26 | 15 | |
| 41 | 26 | 19 | |
| 42 | 30 | 9 | |
| 43 | 33 | 10 | |
| 44 | 33 | 14 | |
| 45 | 33 | 16 | |
| 46 | 34 | 2 | |
| 47 | 34 | 5 | |
| 48 | 35 | 17 | |
| 49 | 35 | 21 | |
| 50 | 36 | 3 | |
| 51 | 37 | 1 | |
| 52 | 37 | 4 | |
| 53 | 38 | 30 | |
| 54 | 40 | 2 | |
| 55 | 42 | 8 | |
| 56 | 1 | 1 | b |
| 57 | 1 | 4 | a |
| 58 | 1 | 8 | c |
| 59 | 1 | 8 | a |
| 60 | 1 | 9 | b |
| 61 | 2 | 13 | a |
| 62 | 2 | 19 | c |
| 63 | 11 | 1 | b |
| 64 | 17 | 9 | d |
| 65 | 20 | 24 | a |
| 66 | 23 | 4 | e |
| 67 | 26 | 28 | c |
| 68 | 33 | 8 | b |
| 69 | 36 | 3 | a |
| 70 | 39 | 2 | c |
| 71 | 41 | 1 | e |
| 72 | 41 | 4 | b |
| 73 | 42 | 28 | a |
| 74 | 43 | 8 | |
| 75 | 43 | 9 | |
| 76 | 43 | 4 | a |
| 77 | 44 | 8 | |
| 78 | 44 | 9 | |
| 79 | 44 | 4 | a |

In the above, the number of $RSO_3H$ (p) is 0 or 1.

These compounds can be readily synthesized according to the conventional method, and exemplary examples are described below.

SYNTHESIS EXAMPLE 1

Synthesis of Exemplified Compound 8

Reaction scheme:

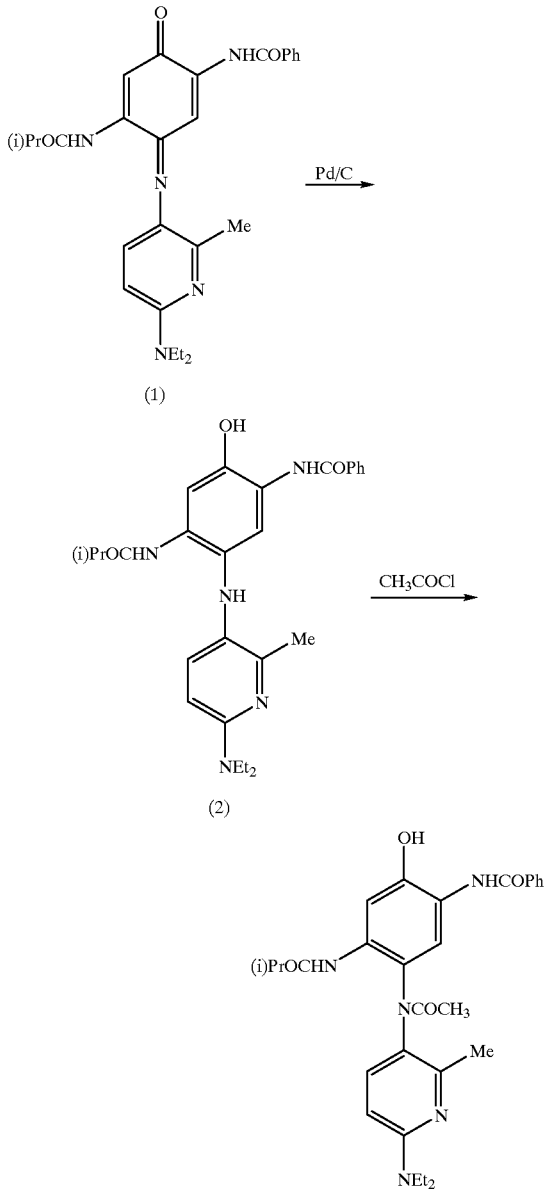

Exemplified compound 8

3.9 g of (1) was dissolved in 50 ml of ethyl acetate, 0.5 g of 5% Pd/C was added thereto and catalytic hydrogenation was carried out at ordinary pressure. Blue color of the reaction mixture disappeared and (2) was produced.

Then, to the reaction mixture were added 1.2 g of triethylamine and 1.5 g of acetylchloride, and stirring was continued for 2 hrs. at room temperature. Catalyst and insoluble material were filtered out and the residue was dissolved in ethyl acetate and recrystalized to obtain exemplified compound 8 of 3.8 g (yield, 89%). The structure was confirmed by NMR spectrum and Mass spectrum.

SYNTHESIS EXAMPLE 2

Synthesis of Exemplified Compound 9

Reaction scheme:

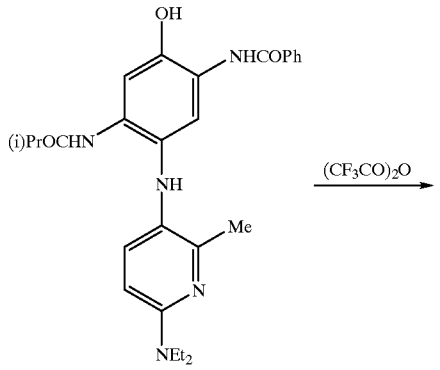

(2)

-continued

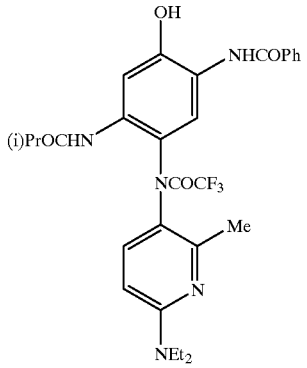

Exemplified compound 9

3.9 g of (1) of Example 1 was dissolved in 50 ml of ethyl acetate, 0.5 g of 5% Pd/C was added thereto and catalytic hydrogenation was carried out at ordinary pressure. Blue color of the reaction mixture disappeared and (2) was produced.

Then, to the reaction mixture were added 1.2 g of triethylamine and 4.0 g of trifluoroacetic acid anhydride, and stirring was continued for 2 hrs. at room temperature. Catalyst and insoluble material were filtered out and the residue was dissolved in ethyl acetate and recrystalized to obtain exemplified compound 9 of 4.0 g (yield, 85%). The structure was confirmed by NMR spectrum and Mass spectrum.

SYNTHESIS EXAMPLE 3

Synthesis of Exemplified Compound 58

Reaction scheme:

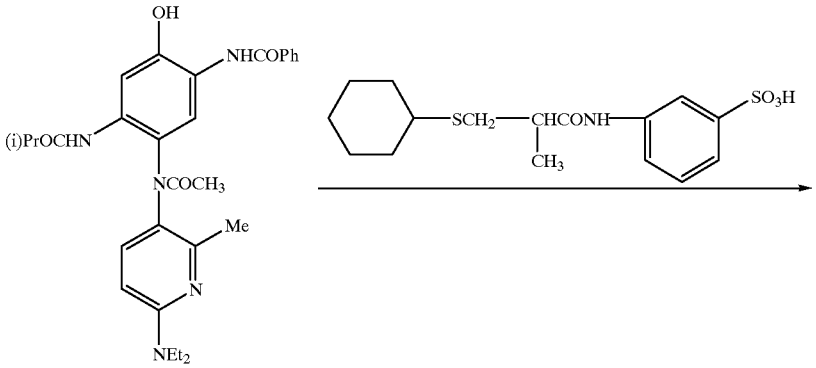

Exemplified compound 8

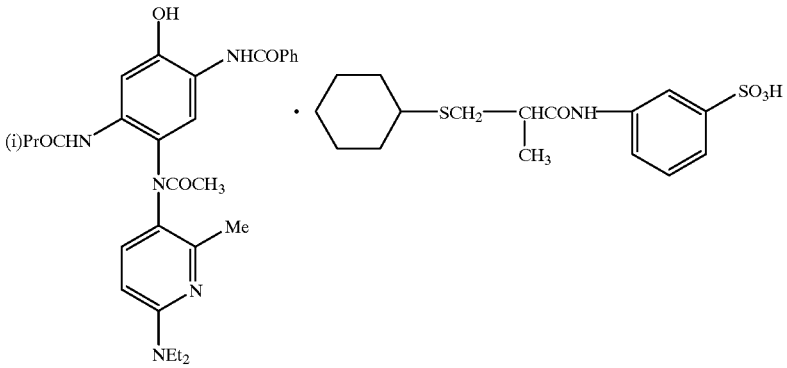

Exemplified compound 58

3.5 g of exemplified compound 8 was dissolved in 30 ml of methanol, 2.6 g of p-toluenesulfonic acid monohydrate was added thereto and stirring was further continued.

Then, the reaction mixture was poured into water of 300 ml and filtered out to obtain exemplified compound 58 of 4.1 g (yield, 87%). The structure was confirmed by NMR spectrum and Mass spectrum.

Compound other than the above were also be readily synthesized in a manner similar to the above synthesis examples.

The addition amount of the compound represented by formula (1) through (4), particularly in the case of medical photographic materials, is preferably not less than $1\times10^{-6}$ mol per mol of silver and less than $5\times10^{-1}$ mol per mol of silver. In cases of being less than the lower limit, improvement of silver image tone is small and in cases of being not less than the upper limit, overall images appear to be unfavorable dark. The addition amount is more preferably not less than $5\times10^{-5}$ mol per mol of silver and less than $5\times10^{-2}$ and furthermore preferably, not less than $5\times10^{-4}$ mol per mol of silver and less than $1\times10^{-2}$ mol per mol of silver.

The compound represented by formula (1) through (4) can added in an optional manner, depending on propertied of the compound. For example, a method in which the compound is added in the form of a dispersion of solid fine particles, a method in which the compound is dissolved in a high boiling solvent and then dispersed in a manner similar to the above and a method in which the compound is dissolved in a water-miscible organic solvent (e.g., methanol, ethanol, acetone, etc.) and then added, are cited. Among these, addition in the form of a solid fine particle dispersion or through solution in the water-miscible organic solvent is preferred. In the case of being added in the form of a solid fine particle dispersion, conventional dispersing methods, such as acid precipitation method, ball mill, jet mill and impeller dispersion can be applied. The average size of dye fine particles may be optional, preferably 0.01 to 20 $\mu$m, and more preferably, 0.03 to 2 $\mu$m.

The number (p) of $RSO_3H$ of the compound represented by formula (1) is an integer of 0 to 3.

The compound represented by formulas (1) may be incorporated in any of photographic component layers. In the case of X-ray photographic use, the compound is preferably incorporated in an emulsion layer or a layer between a support and the emulsion layer and more preferably, in a cross-over shielding layer.

Next, spectral sensitization used in the invention will be detailed. Spectral sensitizing dyes (simply denoted as sensitizing dyes) used in the invention are those having a solubility of 2×19 to 4×10 mol/l in water at 27° C., which is substantially free from an organic solvent and/or surfactant. Examples of the dyes are shown below

| | | Solubility in water (mol/l) |
|---|---|---|
| D-1 | 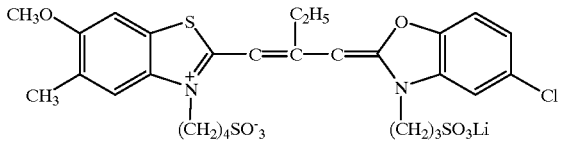 | $13.1\times10^{-3}$ |
| D-2 | 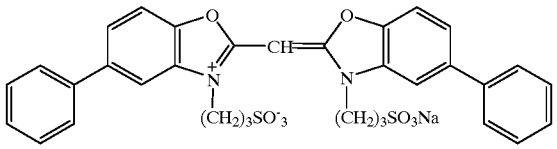 | $11.0\times10^{-3}$ |
| D-3 | 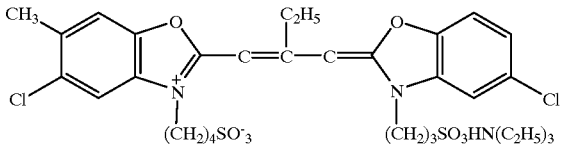 | $8.21\times10^{-3}$ |
| D-4 | 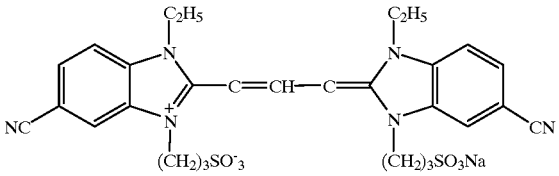 | $5.75\times10^{-3}$ |
| D-5 | 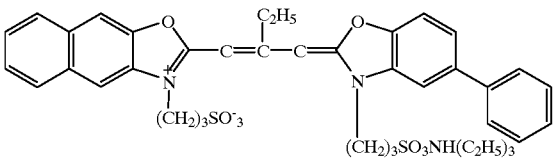 | $3.69\times10^{-3}$ |

-continued
| | | Solubility in water (mol/l) |
|---|---|---|
| D-6 | 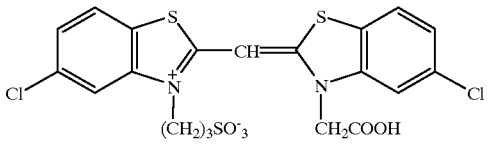 | $1.63 \times 10^{-3}$ |
| D-7 | 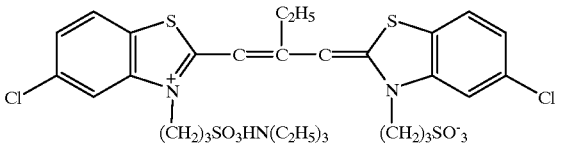 | $1.42 \times 10^{-3}$ |
| D-8 | 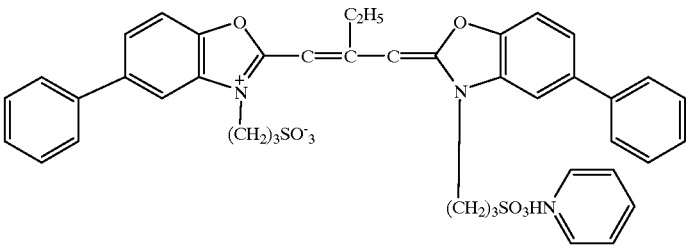 | $0.89 \times 10^{-3}$ |
| D-9 | 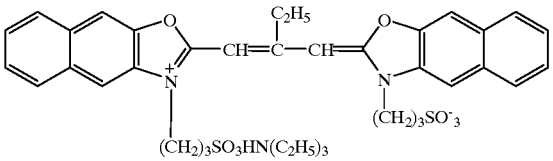 | $0.37 \times 10^{-3}$ |
| D-10 | 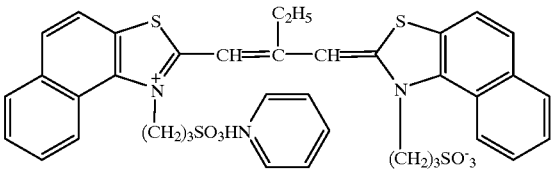 | $0.30 \times 10^{-3}$ |
| D-11 | 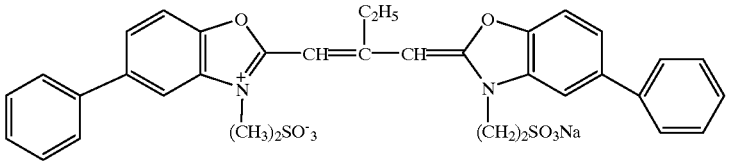 | $0.18 \times 10^{-3}$ |
| D-12 | 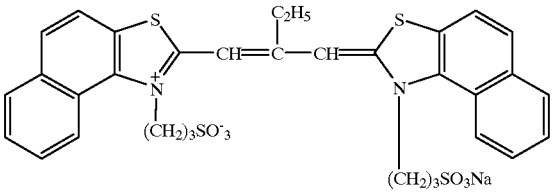 | $0.07 \times 10^{-3}$ |

-continued

| | | Solubility in water (mol/l) |
|---|---|---|
| D-13 | 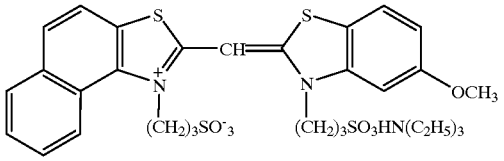 | $70.0 \times 10^{-3}$ |

The sensitizing dye is mechanically ground in an aqueous solvent and dispersed in the form of solid fine particles with a size of not more than 1 $\mu$m. The solid particle dispersion can be prepared using various types of dispersing machines, such as a ball mill, sand mill, colloid mill and ultrasonic homogenizer, and a high-speed stirring machine is preferably employed in the invention.

These sensitizing dyes are used singly or in combination, and the use in combination is often employed for the purpose of supersensitization. There may be incorporated a dye having no spectral sensitizing capability or a substance having no absorption within the visible light region, each of which exhibits super sensitization together with a sensitizing dye, such as an aminostilbene compound substituted with a nitrogen containing heterocyclic group described in U.S. Pat. Nos. 2,933,290 and 3,635,721; an aromatic organic acid/formaldehyde condensation product described in U.S. Pat. No. 3,743,510; cadmium; and azaindene compound. These compounds may be added at any time during the course of nucleation, grain growth, desalting and chemical sensitization, and after chemical sensitization.

Chemical ripening of silver halide grains used in the invention is conducted using gold sensitization, sulfur sensitization, reduction sensitization, charcogen sensitization or a combination thereof.

Chemical sensitization is conducted using so-called sulfur sensitization, gold sensitization, sensitization with a novel metal of the VIII group of the periodic table (e.g. Pd, Pt), or combination thereof. Of these is preferred a combination of gold sensitization and sulfur sensitization, or a combination of gold sensitization and selenium compound. The selenium compound may be added in an optional amount and preferably in combination with sodium thiosulfate. The molar ratio of the selenium compound to sodium thiosulfate is preferably not more than 2:1, and more preferably not more than 1:1. Reduction sensitization is also employed in combination.

The selenium sensitizer includes a variety of selenium compounds. Thus, the selenium sensitizer includes colloidal selenium element, isoselenocyanates (e.g., allylisoselenocyanate, etc.); selenoureas (e.g., N,N-dimethylselenourea, N,N,N'-triethylselenourea, N,N,N'-trimethyl-N'-heptafluoroselenourea, N,N,N'-trimethyl-N'-heptafluoropropylcarbonylselenourea, N,N,N'-trimethyl-N'-4-nitrophenylcarbonylselenourea, etc.); selenoketones (e.g., selenoacetone, selenoacetophenone, etc.); selenoamides) e.g., selenoacetoamide, N,N-dimethylselenobenzamide, etc.); selenocarboxylic acids and selenoesters (e.g., 2-selenopropionic acid, methyl-3-selenobutylate, etc.); selenophosphates (e.g., tri-p-triselenophosphate, etc.); and selenides (e.g., triphenylphosphineselenide, diethyldiselenide, etc.). Specifically, preferred selenium sensitizers are selenides, selenoureas, selenoamides and selenoketones.

The addition amount of the selenium sensitizer is varied, depending on the selenium compound, silver halide grains or chemical ripening conditions and, in general, $1\times10^{-8}$ to $1\times10^{-4}$ mol per mol of silver halide. The incorporation of the selenium sensitizer into the emulsion may be carried out by any one of optimal methods according to properties of the selenium sensitizer used, such as by adding in the form of a solution of it dissolved in water or in an organic solvent such as ethanol or a mixture thereof; by adding in the form of a previously prepared mixture of it with n aqueous gelatin solution; or by adding in the form of an emulsified dispersion of it with an organic solvent-soluble polymer, as disclosed in JP-A 4-140739.

The chemical-ripening temperature with the use of the selenium sensitizer is preferably 40 to 90 k C, and more preferably 45 to 80 k C. The pH and pAg are preferably 4 to 9 and 6 to 9.5, respectively.

It is preferred to supply iodide ions during chemical sensitization or at the time of completion thereof, in terms of sensitivity or dye adsorption. Specifically, it is preferred to add in the form of fine particles of silver iodide.

Chemical sensitization is preferably conducted in the presence of a compound capable of adsorbing to silver halide Examples of the compound include azoles, diazoles, triazoles, tetrazoles, indazoles, thiazoles, pyrimidines and azaindenes; and specifically, a compound containing a mercapto group is preferred.

The silver halide photographic material to be processed according to the invention may be subjected to reduction-sensitizing treatment. Silver halide emulsions are subjected to reduction sensitization by a method of adding a reducing compound, a method a so-called silver ripening by passing through condition at a pAg of 1 to 7 and in excess of silver ions, or a method of so-called high pH ripening by passing through conditions at a high pH of 8 to 11. These methods may be employed in combination.

Addition of the reducing compound is preferable in terms of capability of finely-controlling an extent of reduction sensitization. The reducing compound may be any of an organic or inorganic compounds. Examples thereof include thiourea dioxide, stannous salts, amines or polyamines, hydrazine derivatives, formamidinesulfinic acids, silane compounds, borane compounds, ascorbic acid and its derivatives, and sulfites. The adding amount of the reducing compound depends on reducing ability of the compound, silver halide or preparation conditions such as dissolution condition, and is preferably $1\times10^{-8}$ to $1\times10^{-2}$ mol per mol of silver halide. The reducing compound is dissolved in water or an organic solvent such as alcohol, and added at a time of from grain growth to immediately before coating.

The reducing compounds are preferably added in combination thereof, as described in U.S. Pat. Nos. 3,615,613, 3,615,641, 3,617,295 and 3,635,721.

As a hydrophilic colloid or binder used in the invention is preferably employed gelatin, but other hydrophilic colloids can also be employed. Examples thereof include gelatin derivatives, graft polymer of gelatin and another polymer, proteins such as albumin and casein, cellulose derivatives such as hydroxyethylcellulose, carboxymethylcellulose and cellulose sulfuric acid ester, saccharide derivatives such as sodium alginate, dextran and starch derivatives, and various kinds of synthetic polymeric materials of a polyvinyl alcohol and its partial acetal, poly-N-vinylpyrrolidone, polyacrylic acid, polymethacrylic acid, polyacrylamide, polyvinylimidazole, polyvinylpyrazole, and including their copolymers. Dextran or polyacrylamide having an average molecular weight of 5,000 to 100,000 is preferably used in combination with gelatin.

Examples of gelatin include lime-treated gelatin, acid-treated gelatin, enzyme-treated gelatin described in Bull. Soc. Sci. Phot. Japan, Vol 16, page 30 (1966), and further gelatin derivatives modified with acid halides, acid anhydrides, isocyanates, bromoacetic acid, alkane saltones, vinylsulfonamides, maleic acid imides, polyalkyleneoxides or epoxy compounds.

When a dye capable of being decolorized or leached during processing is incorporated in at least one of silver halide emulsion layer(s) and other component layer(s), there can be obtained a highly sensitive photographic material with high sharpness and rapid processability. Dyes usable in photographic materials can be optimally selected from those which can enhance sharpness by absorbing desired wavelengths in response to requirements of the photographic material to remove effects of the wavelengths. It is preferred that the dye be decolorized or leached out of the photographic material during processing and when the image is completed, that it reaches state in which residual coloring can be visually observed.

The dye is preferably added in the form of a solid fine particle dispersion. The solid fine particle dispersion of the dye can be prepared by using a surfactant and a dispersing means such as a ball mill, vibrating mill, sand mill, roller mill, jet mill or disc impeller mill. Dye dispersion can be prepared in a manner such that a dye is dissolved in an aqueous weak alkaline solution and is precipitated in the form of solid fine particle by lowering the pH of the solution to weak acidity or by simultaneously mixing an aqueous weak alkaline dye solution and an acidic aqueous solution to form solid fine particles. The dye can be used singly or in combination of two or more kinds thereof. When used in combination, dyes can be separately dispersed, followed by mixing; or simultaneously dispersed.

The dye is preferably incorporated into a silver halide emulsion layer, a layer closer to a support or both thereof and more preferably a layer adjacent to the support. The dye is preferably high in concentration in the side closer to the support. An incorporating amount of the dye can be optionally varied in response to required sharpness. Thus, it is preferably incorporated in an amount of 0.2 to 20 mg/m$^2$ and more preferably 0.8 to 15 mg/m$^2$.

In the case of dyeing a silver halide emulsion layer, the dye is added into a silver halide emulsion or a hydrophilic colloid solution, which is coated, directly or through another hydrophilic colloid layer, onto the support.

As described above, the dye is preferably high in concentration in the closer side to the support. A mordant can be used to fix the dye in the closer side to the support. There can be used, e.g., non-diffusible mordant capable of holding the dye. There are known in the art a variety of methods of holding the dye together with the non-diffusible mordant, and it is preferred to hold them in a gelatin binder. Alternatively, they are held together in an appropriate binder and then dispersed in an aqueous gelatin solution by a means such as an ultrasonic homogenizer. The holding ratio depends on the kind of compounds to be used and is conventionally 0.1 to 10 parts by weight per 1 part by weight of a water-soluble dye. Since the dye is held together with the mordant, it can be used in an amount more than when used singly. There may further be provided a layer for incorporating the dye and mordant. The layer can be provided at any position and is preferably coated adjoining to the support.

As surfactants for use in preparing a solid particle dispersion of the dye is usable any of anionic surfactants, nonionic surfactants and cationic surfactants. There are preferably used anionic surfactants such as alkylsulfonates, alkylbenzenesulfonates, alkylnaphthalenesulfonates, alkylsulfonic acid esters, sulfosuccinic acid esters, sulfoalkylpolyoxyethylene alkylphenyl ethers and N-acyl-N-alkyltaurines, and nonionic surfactants such as saponin, alkyleneoxide derivatives and alkylesters of saccharide.

The amount of the anionic surfactant/nonionic surfactant to be used depends on the kin of the surfactant or conditions for dispersing the dye, and is conventionally 0.1 to 2000 mg. preferably 0.5 to 1000 mg and more preferably 1 to 500 mg per 1 g of a dye. Alternatively, the surfactant is used in an amount of 0.01 to 10% by weight and preferably 0.1 to 5% by weight in the dye dispersion. The surfactant is preferably added prior to the start of dispersing the dye, and if necessary, further added after dispersing. The anionic surfactant and/or the nonionic surfactant can be used singly or in combination of each or both.

In case where silver halide emulsion layer(s) are provided on one side of the support, there is generally provided a layer containing an antihalation dye. The antihalation dye containing layer may be provided between the emulsion layer and the support or on the opposite side to the emulsion layer, and preferably on the side opposite to the emulsion side in terms of freedom of selecting the dyes. A transmission density at exposing light wavelengths of the dye containing layer 0.4 to 1.5 and preferably 0.45 to 1.2. The dye is incorporated, depending on properties thereof, by adding in the form of an aqueous solution, micelle dispersion or solid particle dispersion.

In the surface layer of photographic materials can be employed, as a lubricant, silicone compounds described in U.S. Pat. Nos. 3,489,576 and 4,047,958, colloidal silica described in JP-B 56-23139 (herein, the term, "JP-B" means examined and published Japanese Patent), parafin wax, higher fatty acid esters and starch derivatives. To photographic component layer(s) can be, as a plasticizer, polyols such as trimethylol propane, pentanediol, butanediol, ethylene glycol and glycerin.

Polymeric latex:

Polymeric latexes can be incorporated into at least one of a silver halide emulsion layer and other component layers for enhancement of pressure resistance. As the polymeric latexes are preferably employed a homopolymer of an alkyl acrylate, its copolymer with acrylic acid or styrene-butadiene copolymer and a polymer which is comprised of monomer containing an active methylene group, water-solubilizing group or a group capable of cross-linking with gelatin, or its copolymer. There is preferably employed a copolymer which is comprised of a hydrophobic monomer, as main component, such as alkyl acrylate or styrene and monomer containing a water-solubilizing group or a group capable of cross-linking with gelatin to enhance miscibility with gelatin. Examples of the monomer containing a water-solubilizing group include acrylic acid, methacrylic acid, maleic acid, 2-acrylamido-2-methylpropane sulfonic acid and styrenesulfonic acid. Examples of the monomer containing a group capable of cross-linking with gelatin include glycidyl acrylate, glycidyl methacrylate and N-methylol acrylamide.

As matting agents usable in photographic materials can be employed particles of polymethylmethacrylate, copolymer of methylmethacrylate and methacrylic acid, organic compounds such as starch, or inorganic compounds such as silica, titanium dioxide, strontium sulfate and barium sulfate. The particle size is 0.6 to 10 $\mu$m and preferably 1 to 5 $\mu$m. Organic aggregate particles can also be employed as a matting agent. The organic aggregate particle is referred to as an aggregate comprised of primary particles with sizes of 0.05 to 0.50 $\mu$m, and having particle size of 1.0 to 20 $\mu$m. The shape of the particles may be sphere or irregular. An organic component is selected from alkylmethacrylates, alkylacrylates, fluorine- or silicon-substituted alkylmethacrylate, acrylates, and styrene, which may be a homopolymer or copolymer. Of these is preferable polymethyl methacrylate, such as GR-5 or GR-5P produced by Soken Kagaku Corp. The addition of 10 to 200 mg/m$^2$ is effective without causing haze.

Inorganic particles can be incorporated in a silver halide emulsion layer to enhance pressure resistance. The inorganic particles are mainly comprised of an oxide of a metal selected from silicon, aluminum, titanium, indium, yttrium, tin, antimony, zinc, nickel, copper, iron, cobalt, manganese, molybdenum, niobium, zirconium, vanadium, alkaline metals and alkaline earth metals. Of these, silicon oxide (colloidal silica), aluminum oxide, tin oxide, vanadium oxide and yttrium oxide are preferred in terms of transparency and hardness. The surface of the inorganic oxide may be treated with alumina, yttrium or cerium for enhancement of aqueous-dispersing stability as sol dispersed in water. To enhance miscibility with gelatin, the inorganic particles may be covered with shell of previously-cured gelatin. The amount of the inorganic particles to be added is 0.05 to 1.0 and preferably 0.1 to 0.7 of the weight of dried gelatin. The inorganic particles can be used in combination. The particle size of the inorganic particles is preferably 1 to 300 nm.

An aqueous-soluble polymer is preferably incorporated into photographic materials. Polyacrylamide described in U.S. Pat. No. 3,271,158, polyvinyl alcohol and polyvinyl pyrrolidone are effectively employed. Polysaccharides such as dextrin, saccharose and Pullulan are also effective. Of these are preferably employed polyacrylamide and dextrin, and more preferably dextrin. An average molecular weight of the polymer is preferably not more than 20,000 and more preferably not more than 10,000.

Silver halide light sensitive photographic materials used in the invention include black-and-white photographic materials (e.g., photographic materials for medical use, photographic materials for use in graphic arts, negative photographic material for general use, etc.), color photographic materials (e.g., color negative photographic materials, color reversal photographic materials, color photographic materials for print, etc.), diffusion transfer type photographic material and heat-processable photographic materials. Of these is preferred black-and-white photographic materials and particularly photographic materials for medical use. In the photographic materials used in the invention, a developing agent such as aminophenol, ascorbic acid, pyrocatechol, hydroquinone, phenylenediamine or 3-pyrazolidone may be incorporated in a silver halide emulsion layer or an adjacent layer thereto.

It is preferred to incorporate an inorganic or organic hardener into a silver halide emulsion layer or a light insensitive hydrophilic colloid layer. Example thereof include chromium salts (e.g., chrome alum, chrome acetate), aldehydes (e.g., formaldehyde, glyoxal, glutar aldehyde), N-methylol compounds (e.g., dimethylol urea, methylol dimethylhydantoin), dioxane derivatives (e.g., 2,3-dihydroxydioxane), active vinyl compounds [e.g., 1,3,5-triacryloyl-hexahydro-s-triazine, bis(vinylsulfonyl)methyl ether, N,N'-methylenebis(β-(vinylsulfonyl)propioneamide], active halogen compounds (e.g., 2,4-dichloro-6-hydroxy-s-triazine), mucohalogenic acids (e.g., mucochloric acid, mucophenoxychloric acid), isooxazoles and 2-chloro-6-hydroxytriazinylated gelatin. These hardeners are used singly or in combination thereof. Of these hardeners are preferably used active vinyl compounds and active halogen compounds. Polymeric hardeners are also employed as an effective hardener. Examples thereof include dialdehyde starch, polymers containing an aldehyde group such as polyacrolein and acrolein copolymer, polymers containing an epoxy group, polymers containing a dichlorotriazine group, polymers containing active ester group, and polymers containing active vinyl group or its precursor. Of these is preferred a polymer in which an active vinyl group or its precursor is bonded through a long spacer to the main polymer chain.

Swelling of the photographic material during the process of developing, fixing and washing can be controlled by previously adding a hardener into the photographic material in the process of coating, whereby it is preferred to control a water content in the photographic material before drying. Swelling percentage of the photographic material during processing is preferably 150 to 250% and a swelling layer thickness is preferably not more than 70 $\mu$m. When the swelling percentage exceeds 250%, drying defects occur, resulting in transport problems in processing by an automatic processor, particularly in rapid-processing. When the swelling percentage is less than 150%, uneven development or residual coloring tends to occur. Herein, the swelling percentage is defined as a difference in layer thickness between before and after being swelled in processing solution(s), divided by a layer thickness before being swelled and multiplied by 100 (%)

Examples supports used in the invention include those described in Research Disclosure 17643 (hereinafter, denoted as "RD-17643") page 28; and RD-308119, page 1009. An appropriate support is plastic resin films. The surface of the support may be provided with a subbing layer or subjected to corona discharge treatment or ultraviolet irradiation to improve adhesion property of the coating layer.

To a silver halide emulsion layer or another photographic component layer are included a variety of adjuvants in response to various objectives. Examples thereof are described in RD-17643 (December, 1978), RD-18716 (November, 1979) and RD-308119 (December, 1989), as shown below.

| | RD-17643 | | RD-18716 | RD-308119 | |
|---|---|---|---|---|---|
| Additive | Page | Sec. | Page | Page | Sec. |
| Chemical sensitizer | 23 | III | 648 upper right | 996 | III |
| Sensitizing dye | 23 | IV | 648–649 | 996–8 | IVA |
| Desensitizing dye | 23 | IV | | 998 | IVB |
| Dye | 25–26 | VIII | 649–650 | 1003 | VIII |
| Developing accelerator | 29 | XXI | 648 upper right | | |
| Antifoggant/stabilizer | 24 | IV | 649 upper right | 1006–7 | VI |

-continued

| Additive | RD-17643 Page | RD-17643 Sec. | RD-18716 Page | RD-308119 Page | RD-308119 Sec. |
|---|---|---|---|---|---|
| Brightening agent | 24 | V | | 998 | V |
| Hardening agent | 26 | X | 651 left | 1004–5 | X |
| Surfactant | 26–27 | XI | 650 right | 1005–6 | XI |
| Antistatic agent | 27 | XII | 650 right | 1006–7 | XIII |
| Plasticizer | 27 | XII | 650 right | 1006 | XII |
| Lubricant | 27 | XII | | | |
| Matting agent | 28 | XVI | 650 right | 1008–9 | XVI |
| Binder | 26 | XXII | | 1003–4 | IX |
| Support | 28 | XVII | | 1009 | XVII |

Next, preferable processing of photographic materials according to the invention will be detailed. As developing agent used for developing silver halide photographic materials are generally included hydroquinone, p-aminophenols such as p-aminophenol, N-methyl-p-aminophenol and 2,4-diaminophenol, 1-phenyl-3-pyrazolidones such as 1-phenyl-3-pyrazolidone, 1-phenyl-4-methyl-4-hydroxymethyl-3-pyrazolidone and 5,5-dimethyl-1-phenyl-3-pyrazolidone. These are used singly or in combination thereof. The p-aminophenols or 3-aminopyrazolidones are preferably used in an amount of 0.004 to 0.2 mol/l and more preferably 0.04 to 0.12 mol/l. Further, the total amount of the above described hydroquinones, p-aminophenols and 1-phenyl-3-pyrazolidones contained in a developer is preferably not more than 0.1 mol/l.

Recently, dihydroxybenzenes are not acceptable in terms of environment sot that reductones represented by the following formula (A) are preferably employed:

Formula (A)

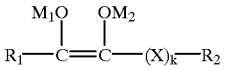

wherein $R_1$ and $R_2$ independently represent a substituted or unsubstituted alkyl group, a substituted or unsubstituted amino group, a substituted or unsubstituted alkoxy group or alkylthio group, and $R_1$ and $R_2$ may combine with each other to form a ring; and k is 0 or 1; and when k is 1, X represents —CO— or —CS—; and $M_1$ and $M_2$ each are a hydrogen atom or alkali metal atom.

In the formula (A), a compound formed by combination of $R_1$ and $R_2$ and represented by the following formula (A-a) is preferred:

Formula (A-a)

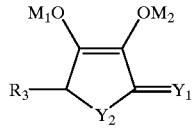

wherein $R_3$ is a hydrogen atom, substituted or unsubstituted alkyl group, substituted of unsubstituted aryl group, substituted or unsubstituted amino group, substituted or unsubstituted alkoxy group, sulfo group, carboxyl group, amido group or sulfonamido group; $Y_1$ is O or S; $Y_2$ is O, S or $NR_4$, in which $R_4$ is a substituted or unsubstituted alkyl group or substituted or unsubstituted aryl group; and $M_1$ and $M_2$ each are a hydrogen atom or alkali metal atom.

As the alkyl group of formula (A) and formula (A-a) is preferred a lower alkyl group, such as an alkyl group having 1 to 5 carbon atoms; the amino group is preferably an unsubstituted amino group or amino group substituted by a lower alkoxy group; the alkoxy group is preferably a lower alkoxy group; the aryl group is preferably a phenyl group or naphthyl group; these groups may be substituted and as substituents are cited hydroxy group, halogen atom, alkoxy group, sulfo group, carboxy group, amido group, and sulfonamido group.

Examples of the compound represented by formulas (A) and (A-a) are shown below, but the present invention is not limited thereto.

Formula (A)

| Compound No. | X | | $R_1$ | $R_2$ | $M_1$ | $M_2$ |
|---|---|---|---|---|---|---|
| A-1 | — | (k = 0) | $HOCH_2$—CH(OH)—CH(OH)— | —OH | H | H |
| A-2 | — | (k = 0) | $CH_3$—CH(OH)—CH(OH)— | —OH | H | H |
| A-3 | — | (k = 0) | $HOCH_2$—CH(OH)—CH(OH)— | —$CH_3$ | H | H |
| A-4 | — | (k = 0) | $CH_3$—CH(OH)—CH(OH)— | —$CH_3$ | H | H |
| A-5 | —C(=O)— | (k = 1) | $HOCH_2$—CH(OH)—CH(OH)— | —OH | H | H |

-continued

| | | | | | | |
|---|---|---|---|---|---|---|
| A-6 | —C(=O)— | (k = 1) | $CH_3$—CH(OH)—CH(OH)— | —OH | H | H |
| A-7 | —C(=S)— | (k = 1) | $HOCH_2$—CH(OH)—CH(OH)— | —OH | H | H |
| A-8 | —C(=S)— | (k = 1) | $CH_3$—CH(OH)—CH(OH)— | —OH | H | H |
| A-9 | —C(=O)— | (k = 1) | HO—$CH_2$— | —OH | Na | H |
| A-10 | —C(=O)— | (k = 1) | HO—$CH_2$— | —$CH_3$ | H | H |
| A-11 | —C(=O)— | (k = 1) | HO—$CH_2$— | —$C_2H_5$ | H | H |
| A-12 | —C(=O)— | (k = 1) | HO—$CH_2$— | —$C_2H_4OH$ | H | Na |

Formula (A-a)

| Compound No. | $Y_1$ | $Y_2$ | $R_3$ | $M_1$ | $M_2$ |
|---|---|---|---|---|---|
| A-13 | O | O | H | H | H |
| A-14 | O | O | $H_3C$— | H | H |
| A-15 | O | O | $CH_2$—CH(OH)— | H | H |
| A-16 | O | O | $CH_3$—CH(OH)— | H | H |
| A-17 | O | O | $HOCH_2$—CH(OH)— | H | H |
| A-18 | O | O | $CH_3$—CH(OH)— | Na | H |
| A-19 | O | O | $HOOCCH_2$—CH(OH)— | H | Na |
| A-20 | S | O | H | Na | H |
| A-21 | S | O | $CH_3$—CH(OH)— | H | H |
| A-22 | S | O | $HOCH_2$—CH(OH)— | H | H |
| A-23 | O | $NCH_3$ | H | H | H |
| A-24 | O | NH | $HOCH_2$—CH(OH)— | H | K |
| A-25 | O | S | H | H | H |

-continued

| | | | | | |
|---|---|---|---|---|---|
| A-26 | O | S | $HOCH_2-CH(OH)-$ | H | H |
| A-27 | O | S | $CH_3-CH(OH)-$ | H | H |
| A-28 | S | S | H | H | H |
| A-29 | S | S | $HOCH_2-CH(OH)-$ | H | H |
| A-30 | S | S | H | H | H |

These compounds are exemplarily ascorbic acid, erythorbic acid or derivatives derived therefrom, being commercially available and readily synthesized by a well known method. When using a developing solution containing the above-described reductones, there were effects of improving silver image tone, which was not achieved by conventional development.

As a preservative is contained sulfites such as potassium sulfite and sodium sulfite or reductones such as piperidinohexose reductone. These are preferably contained in an amount of 0.2 to 1 mol/l and more preferably 0.3 to 0.6 mol/l. Addition of a large amount of ascorbic acid leads to improved processing stability.

As examples of an alkaline agent including a pH adjusting agent are cited sodium hydroxide, potassium hydroxide, sodium carbonate, potassium carbonate, sodium phosphate and potassium phosphate. There may also be employed buffering agents such as a borate described in JP-A 61-28708, saccharose described in JP-A 60-93439, acetoxime, 5-sulfosalycylic acid, phosphate and carbonate. The content of these chemicals are selected so as to make the pH of a developing solution 9.0 to 13 and preferably 10 to 12.5.

There may be contained a dissolution aid such as polyethylene glycols or esters thereof, a sensitizing agent such as quaternary ammonium salts, a development accelerating agent and a surfactant. There is also employed an agent for preventing silver sludge, such as an anti-silver-stain agent described in JP-A 56-106244, sulfide or disulfide compounds described in JP-A 3-51844 and cysteine derivatives or triazine compounds described in Japanese Patent Application No. 4-92947.

As restrainers are employed azole type organic restrainers including indazole type, imidazole type, benzimidazole type, triazole type, benztriazole type, tetrazole type and thiadiazole type. Examples of an inorganic restrainer include sodium bromide, potassium bromide and potassium iodide. Besides, there may be employed compounds described in L. F. A. Mason, "Photographic Processing Chemistry" published by Focal Press (1966), page 226–229; U.S. Pat. Nos. 2,193,015 and 2,592,364; and JP-A 48-64933. As a chelating agent for sequestering calcium ions contained in tap water used for preparing processing solution solutions is an organic chelating agent described in JP-A 1-193853, which has 8 or more of a stability constant of a Fe-chelate. Examples of an inorganic chelating agent include sodium hexametaphosphate, calcium hexametaphosphate and polyphosphates.

Dialdehyde compounds can be employed as a hardener in a developer. In this case, glutar aldehyde is preferably employed, provided that inclusion of the hardener in a photographic material is preferred for rapid processing rather than addition into a developer.

A fixing solution contains fixing chemicals known in the art. The pH of the fixing solution is not less than 3.8 and preferably 4.2 to 5.5. Examples of a fixing agent include thiosulfates such as ammonium thiosulfate and sodium thiosulfate. Ammonium thiosulfate is preferable in terms of the fixing speed. The concentration of ammonium thiosulfate is preferably 0.1 to 5 mol/l and more preferably 0.8 to 3 mol/l. The fixing solution may be acid hardening one. Aluminum ions are employed as a hardener and added in the form of aluminum sulfate, aluminum chloride or potassium alum, provided that inclusion of the hardener in a photographic material is preferred for rapid processing rather than addition into a fixing solution. The fixing solution may further contain a preservative such as sulfites or bisulfites, pH-buffering agent such as acetic acid or boric acid, pH-adjusting agents including various acids such as mineral acid (e.g., sulfuric acid, nitric acid) organic acid (e.g., citric acid, tartaric acid, malic acid), and hydrochloric acid, and metal hydroxides (e.g., potassium hydroxide, sodium hydroxide) and a chelating agent capable of water-softening. Examples of a fixing accelerator include thiourea derivatives and thioethers.

Developing temperature is preferably 25 to 50° C. and more preferably 30 to 40° C. Developing time is 3 to 90 sec. and preferably 5 to 60 sec. The total processing time (i.e., Dry to Dry) is 15 to 210 sec. The processing method as defined below is preferred in terms of rapid processability. Thus, it is preferable to process by an automatic processor satisfying the following requirement:

$$I^{0.75\times}t=40 \text{ to } 90 \ (0.7\leqq I\leqq 4.0)$$

wherein I represents a transport length (unit:cm) between the contact point of a first roller pair at the film inserting entrance of the processor and the contact point of a final roller pair at the film drying entrance; and t represents a time necessary to pass along I described above. Replenishment is made for compensating exhaustion due to processing solutions and aerial oxidation. Examples of replenishing methods include replenishment based on width and transport speed described in JP-A 55-12624; area-replenishment described in JP-A 60-104946; and area-replenishment controlled by the number of continuously-processing sheets, as described in JP-A 1-149156. The replenishing rate is preferably 80 to 500 cc/$m^2$.

EXAMPLES

The present invention will be further explained in detail, based on examples, but is not limited to these examples.

Example 1

Preparation of seed emulsion:

| | | |
|---|---|---|
| A1 | Ossein gelatin | 24.2 g |
| | Water | 9657 ml |
| | Sodium polypropyleneoxy-polyethyleneoxy-disuccinate (in an aqueous 10% methanol solution) | 6.78 ml |
| | Potassium bromide | 10.8 g |
| | 10% nitric acid solution | 114 ml |
| B1 | Aqueous 2.5N silver nitrate solution | 2825 ml |
| C1 | Potassium bromide | 841 g |
| | Add water to make | 2825 ml |
| D1 | An aqueous 1.75N potassium bromide solution | |
| | An amount for controlling the following silver potential | |

To Solution A1, Solutions B1 and C1 were each added in an amount of 464.3 ml at 42° C. by making use of a mixing stirrer shown in JP-B 58-58288 in a double-jet process by taking 1.5 minutes, so that nucleus grains were formed (herein, the term JP-B refers to examined and published Japanese Patent).

After stopping the addition of Solutions B1 and C1, the temperature of Solution A1 was raised to 60° C. by taking 60 minutes and the pH thereof was adjusted to be 5.0 by making use of a 3% KOH solution. Thereafter, Solutions B1 and C1 were each added thereto again at a flow rate of 55.4 ml/min. for 42 minutes in the double-jet process. At the time for raising the temperature from 42° C. to 60° C. and the time for the subsequent double-jet process carried out with Solutions B1 and C1, the silver potential (measured by a silver-ion selection electrode together with a saturated silver-silver chloride electrode as a control electrode) was so controlled as to be +8 mV and +16 mV by making use of Solution Dl, respectively.

After the completion of the addition, the pH was adjusted to be 6 with a 3% KOH solution and a desalting treatment were immediately made. The resulting seed emulsion was proved through an electron microscope as follows. Not less than 90% of the total projected area of the silver halide grains thereof were accounted for by hexagonal, tabular grains having the maximum adjacent edge ratio within the range of 1.0 to 2.0; and the average thickness and average grain-size (converted into the diameter of the corresponding circle, i.e., equivalent circular diameter) of the hexagonal tabular grains were proved to be 0.064 μm and 0.595 μm, respectively. Further, the variation coefficients of the grain thickness and the distance between the twin planes thereof were proved to be 40% and 42%, respectively.

Preparation of emulsions, Em-1:

By making use of Seed emulsion-1 and the following 4 kinds of solutions, silver halide tabular grain emulsion Em-1 was prepared.

| | | |
|---|---|---|
| A2 | Ossein gelatin | 34.03 g |
| | Sodium polypropyleneoxy-polyethyleneoxy-disuccinate (in an aqueous 10% ethanol solution) | 2.25 ml |
| | Seed emulsion-1 | Equivalent to 1.722 mols |
| | Water to make | 3150 ml |
| B2 | Potassium bromide | 1734 g |
| | Water to make | 3644 ml |
| C2 | Silver nitrate | 2478 g |
| | Water to make | 4165 ml |

-continued

| | | |
|---|---|---|
| D2 | A fine-grained emulsion* comprising 3 wt % of gelatin and silver iodide grains (having an average grain-size of 0.05μ) | Equivalent to 0.080 mol |

*: To 6.64 liters of an aqueous 5.0 wt % gelatin solution containing 0.06 mol of potassium iodide, 2 liters each of an aqueous solution containing 7.06 mol of silver nitrate and an aqueous solution containing 7.06 mol of potassium iodide were added by taking 10 minutes. In the course of forming the fine grains, the pH was controlled to be 2.0 by making use of silver nitrate, and the temperature was controlled to be 40° C. After completing the grain formation, the pH was adjusted tobe 6.0 by making use of an aqueous sodium carbonate solution.

In a reaction vessel, Solution A2 was vigorously stirred with keeping the temperature at 60° C. Thereto a part of Solution B2, a part of Solution C2 and the half amount of Solution D2 were each added in a triple-jet process by taking 5 minutes. Thereafter, the half amounts each of the remaining Solutions B2 and C2 were added successively by taking 37 min. ; a part of Solution B2, a part of Solution C2 and Solution D2 were added in 15 min.; and finally, the whole remaining amount of Solutions B2 and C2 were each added by taking 33 minutes. In the above-mentioned courses, the pH and pAg thereof were kept at 5.8 and 8.8 for all the while. The flow rates of Solutions B2 and C2 were acceleratedly varied so as to meet the critical growth rate.

After completing the additions, the resulting emulsion was cooled down to 40° C. and desalted by ultrafiltration; thereafter, 10% gelatin aqueous solution was added and redispersed in 30 min. with stirring. After redispersing, the pH and pAg were each adjusted to 5.80 and 8.06 at 40° C.

When observing the resulting silver halide emulsion through an electron microscope, it was proved to be the tabular-shaped silver halide grains having the average diameter of 0.984 μm, the average thickness of 0.22 μm, the average aspect ratio of about 4.5 and the grain-size distribution width of 18.1%. The average spacing between twin planes of the grains was 0.020 μm. In the ratio of the spacing between twin planes to the grain thickness, the grains having not lower than 5 thereof were proved to account for 97% (in numbers) of the total tabular-shaped silver halide grains. Those having not less than 10 were proved to account for 49% of the total grains, and those having not less than 15 accounted for 17% thereof.

Preparation of emulsion Em-2

The emulsion Em-1 was melted at 40° C. and the pAg was adjusted to 7.5 by simultaneously adding silver nitrate and potassium iodide aqueous solutions. In this case, the silver nitrate and potassium iodide aqueous solutions were added in amounts that formed a silver halide deposit containing 12 mol % iodide.

After adding an aqueous solution of sodium chloride of 2 mol %, based on silver of emulsion Em-1, a calcium chloride aqueous solution, sodium bromide aqueous solution, silver iodide fine grain emulsion (the same as used in preparation of Em-1), and silver nitrate aqueous solution were added in this order. The addition of silver nitrate was 6 mol %, based on total silver of final silver halide grains. Finally, the molar ratio of added halides was Cl:Br:I=42:42:16.

As a result of electron microscopic observation of silver halide grains of Em-2, there were observed a number of silver halide protrusions which were epitaxially deposited not only in peripheral portions but also overall (111) major faces.

Preparation of emulsion Em-3:

Emulsion Em-3 was prepared in the same manner as Em-2, except that the following sensitizing dye (A) of 0.6 mmol/Ag mol and sensitizing dye (B) of 0.06 mmol/Ag mol were added in the form of solid fine particles, at the time between the addition of sodium chloride and addition of calcium chloride.

The solid fine particle dispersion of the sensitization dyes were each prepared in the process according to the process described in JP-A 5-297496. Thus, they were prepared in such a manner that a given amount of the spectral sensitization dye was added to water thermally controlled to be 27° C. and it was stirred at 3,500 rpm by making use of a high-speed dissolver for a period within the range of 30 to 120 minutes. In this case, the concentration of dye (A) was adjusted so as to be 2%.

Sensitizing dye (A):

Anhydrous sodium 5,5'-dichloro-9-ethyl-3,3'-(3-sulfopropyl)-oxacarbocyanine

Sensitizing dye (B):

Anhydrous sodium 5,5'-di-(butoxycarbonyl)-1,1'-diethyl-3,3'-di-(4-sulfobutyl)-benzoimidazolocarbo-cyanine As a result of electron microscopic observation of emulsion grains of Em-3, silver halide protrusions which were epitaxially deposited in the peripheral portions of the (111) major faces, were observed.

Chemical sensitization of Em-1 after raising the temperature of the emulsion Em-1 to 60° C., sensitizing dyes (A) and (B) were added thereto in the form of a solid particle dispersion, then, an aqueous solution of adenine, ammonium thiocyanate, chloroauric acid and sodium thiosulfate, and dispersion of triphenylphosphine selenide, and after 30 min., a silver iodide fine grain emulsion was further added to carry out chemical ripening over total period of 2 hr. After completion of chemical ripening, 4-hydroxy-6-methyl-1,3,3a,7-tetrazaindene (TAI) was added in an optimum amount.

Above-described additives and their addition amounts (per mol of silver) are as follows.

| | |
|---|---|
| Sensitizing dye (A) | 0.6 mol |
| Sensitizing dye (B) | 0.006 mol |
| Adenine | 15 mg |
| Ammonium thiocyanate | 95 mg |
| Chloroauric acid | 2.5 mg |
| Sodium thiosulfate | 2.0 mg |
| Silver iodide fine grain emulsion (average grain size of 0.06 μm) | 280 mg |
| Triphenylphosphine selenide | 0.2 mg |
| TAI | 500 mg |

The dispersion of triphenylphosphine selenide was prepared according to the following procedure. Triphenylphosphine selenide of 120 g was added to ethyl acetate of 30 kg at 50° C. with stirring and was completely dissolved. On the other hand, photographic gelatin of 3.8 kg was dissolved in water of 38 kg and an aqueous 25 wt. % solution of sodium dodecylbenzenesulfonate of 93 g was added. Then, these solutions were mixed and dispersed at 50° C. for 30 min. by using a high-speed stirrer type dispersing machine provided with a dissolver having a diameter of 10 cm, at a dispersing blade circulating speed of 40 m/sec. Thereafter, ethyl acetate was promptly removed with stirring under reduced pressure, until reached a concentration of remaining ethyl acetate of 0.3 wt. % or less. The resulting dispersion was diluted with water to make 80 kg. A part of the thus-prepared dispersion was employed in the above.

Preparation of silver iodide fine grain emulsion

| | | |
|---|---|---|
| $A_3$ | Ossein gelatin | 100 g |
| | Potassium iodide | 8.5 g |
| | Water to make | 2000 ml |
| $B_3$ | Silver nitrate | 360 g |
| | Water to make | 605 ml |
| $C_3$ | Potassium iodide | 352 g |
| | Water to make | 605 ml |

To a reaction vessel was added Solution $A_3$ and were further added solutions $B_3$ and $C_3$ by the double jet addition at a constant flow rate in 30 min., while maintained at 40° C. with stirring. During addition, the pAg was maintained at 13.5 by the conventional pAg-controlling method. The resulting emulsion was comprised of silver iodide fine grains with an average size of 0.06 μm, which was a mixture of β-AgI and γ-AgI.

Chemical sensitization of Em-2 and Em-3

Emulsions Em-2 and Em-3 were each chemically sensitized in a manner similar to Em-1, provided that sensitizing dyes (A) and (B) were not added.

On both sides of blue-tinted polyethylene terephthalate film base for use in X-ray with a thickness of 175 μm and blue density of 0.15 were simultaneously coated a cross-over light shielding layer, emulsion layer, and protective layer in this order so as to have coating amounts as shown below and dried to obtain Samples No. 1 to 13.

1st Layer (Cross-over light shielding layer)

| | |
|---|---|
| Solid fine particle dispersion of dye (AH) | 50 mg/m$^2$ |
| Gelatin | 0.2 g/m$^2$ |
| Dextrin (Av. M.W.; 1000) | 0.05 g/m$^2$ |
| Dextran (Av. M.W.; 40000) | 0.05 g/m$^2$ |
| Sodium dodecylbenzene sulfonate | 5 mg/m$^2$ |
| Sodium 2,4-dichloro-6-hydroxy-1,3,5-triazine | 5 mg/m$^2$ |
| Colloidal silica (having an average particle-size of 0.014 μm) | 10 mg/m$^2$ |
| Compound (I) | 5 mg/m$^2$ |

2nd Layer (Emulsion layer)

To each of the emulsions prepared as above were added the following additives, wherein the addition amount was expressed as per mol of silver halide.

| | |
|---|---|
| 1-Phenyl-5-mercapto-tetrazole | 10 mg |
| 1-Trimethylolpropane | 14 g |
| Compound (C) | 30 mg |
| t-Butyl-catechol | 150 mg |
| Polyvinyl pyrrolidone (having a molecular weight of 10,000) | 850 mg |
| A styrene-maleic acid anhydride copolymer | 2.0 g |
| Dextrin (Av. M.W.; 1000) | 1.2 g |
| Dextran (Av. M.W.; 10000) | 1.2 g |
| Nitrophenyl-triphenyl-phosphonium chloride | 50 mg |
| Ammonium 1,3-dihydroxybenzene-4-sulfonate | 1.7 g |
| 1,1-dimethylol,-1-bromo-1-nitromethane | 6.2 mg |
| n-$C_4H_9OCH_2CH(OH)CH_2N(CH_2COOH)_2$ | 700 mg |
| Sodium 2-mercaptobenzimidazole-5-sulfonate | 30 mg |
| Colloidal silica (Ludox, produced by du'Pont) | 28.5 g |
| Latex (L), as soloid component | 28.5 g |
| Compound (D) | 150 mg |
| Compound (E) | 30 mg |
| Compound (F) | 30 mg |

Exemplified leuco compound in an amount shown in Table 2

Gelatin was adjusted to be in an amount of 0.8 g/m$^2$.

3rd Layer (Protective layer)

| | |
|---|---|
| Gelatin | 0.8 g/m$^2$ |
| Matting agent comprising polymethyl methacrylate (having an area average particle-size of 5 $\mu$m) | 21 mg/m$^2$ |
| Matting agent comprising polymethyl methacrylate (having an area average particle-size of 3 $\mu$m) | 28 mg/m$^2$ |
| $(CH_2—CHSO_2CH_2)_2O$ | 36 mg/m$^2$ |
| Formaldehyde | 20 mg/m$^2$ |
| Sodium 2,4-dichloro-6-hydroxy-1,3,5-triazine | 10 mg/m$^2$ |
| Compound (G) | 15 mg/m$^2$ |
| Compound (H) | 5 mg/m$^2$ |
| Compound (I) | 30 mg/m$^2$ |
| Compound (J) | 10 mg/m$^2$ |

The coating amount of silver and gelatin were 1.5 g/m$^2$ and 2.5 g/m$^2$.

Samples obtained were allowed to stand under environment at 40° C. and 50% RH for 24 hr.

Compound (C)

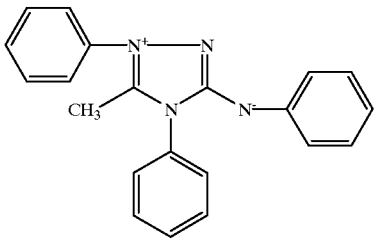

Compound (D)

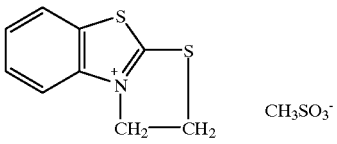

Compound (E)

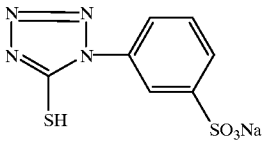

Compound (F)

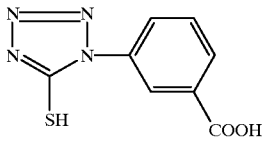

Compound (G)

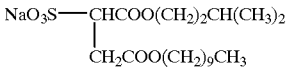

Compound (H)

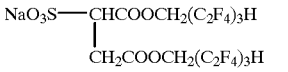

-continued

Compound (I)

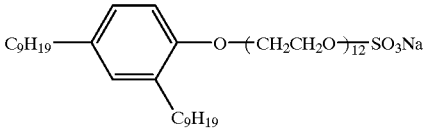

Compound (J)

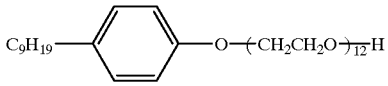

Dye (AH)

in the form of a solid particle dispersion

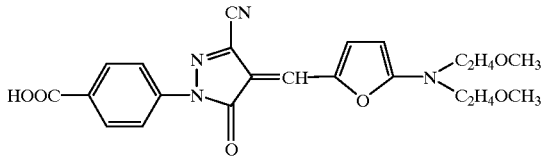

Latex (L)

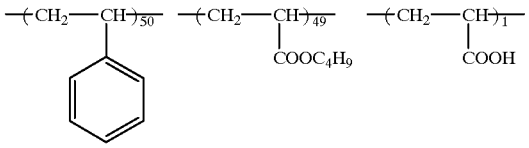

Preparation of processing compositions

According to the following procedure (A) through (D), there were prepared a solid processing compositions in the form of a tablet for use as a developer replenisher or a fixer replenisher.

Procedure (A) for preparing Tablet A of developing replenisher:

Sodium erythorbate 13000 g, as a developing agent was pulverized in a commercially available mill so as to have an average particle size of 10 $\mu$m. To the resulting fine particles, was added sodium sulfite of 4877 g, Phenidone of 975 g and DTPA of 1635 g were added and the mixture was mixed in the mill for 30 min. In stirring granulator commercially available, the resulting mixture was granulated for 1 min. at room temperature by adding 30 ml of water. The resulting granules were dried up at 40° C. for 2 hr. in a fluidized bed drier so that the moisture content of the granules was almost completely removed off. Thus prepared granules (A) was mixed with D-mannitol of 2167 g for 10 min. by making use of a mixer in a room controlled to be not higher than 25° C. and 40% RH. The mixture was compression-tableted so as to have a filling amount of 8.715 g per tablet, by making use of a tableting machine that was modified model of Tough Press Collect 1527HU manufactured by Kikusui Mfg. Works, Inc. Thereby, 2500 tablets (A) for use as developer replenishment were prepared.

Procedure (B) for preparing Tablet B of developing replenisher:

Potassium carbonate of 19500 g, 1-phenyl-5-mercaptotetrazole of 8.15 g, sodium hydrogencarbonate of 3.25 g, glutar aldehyde sulfite adduct of 650 g and polyethylene glycol #6000 of 1354 g were pulverized and granulated in a manner similar to the procedure (A). Added water was 30 ml and after granulation, the resulting granules were dried up at 50° C. for 30 min. so that the moisture content of the granules was almost completely removed off. The mixture was compression-tableted so as to have a filling amount of 9.90 g per tablet, by making use of a tableting machine that was modified model of Tough Press Collect 1527HU manufactured by Kikusui Mfg. Works, Inc. Thereby, 2500 tablets (B) for use in developer replenishment were prepared.

Procedure (C) for preparing Tablet C of fixing replenisher:

Ammonium thiosulfate/sodium thiosulfate of 18560 g, sodium sulfite of 1392 g, sodium hydroxide of 580 g and disodium ethylenediaminetetraacetate of 2.32 g were pulverized in a manner similar to (A) and uniformly mixed by a commercially available mixer. Then, water of 500 ml was added and granulation was carried out in a manner similar to (A). The resulting granules were dried at 60° C. for 30 min. so that the moisture content of the granules was almost completely removed off. The mixture was compression-tableted so as to have a filling amount of 8.214 g per tablet, by making use of a tableting machine. Thereby, 2500 tablets (C) for use as fixer replenishment were prepared.

Procedure (D) for preparing Tablet D of fixing replenisher:

Boric acid of 1860 g, aluminium sulfate (octadecylhydride) of 6500 g, glacial acetic acid of 1860 g and sulfuric acid (50 wt %) of 925 g were pulverized and granulated in a manner similar to the procedure (A). Added water was 100 ml and after granulation, the resulting granules were dried up at 50° C. for 30 min. so that the moisture content of the granules was almost completely removed off. The mixture was compression-tableted so as to have a filling amount of 4.459 g per tablet, by making use of a tableting machine. Thereby, 2500 tablets (D) for use as fixer replenishment were prepared.

Using the prepared developing replenisher tablets was prepared a developing solution having the following composition. To 16.5 liters of the developing solution with a pH of 10.7 was added a starter having the composition as shown below to obtain 330 ml of a developer starting solution with a pH of 10.45.

Developer starting solution:

| | |
|---|---|
| Potassium carbonate | 120.0 g/l |
| Sodium erythorbate | 40.0 g/l |
| DTPA | 5.0 g/l |
| 1-phenyl-5-mercapto-tetrazole | 0.05 g/l |
| Sodium hydrogencarbonate | 20.0 g/l |
| Phenidone | 3.0 g/l |
| Sodium sulfite | 15.0 g/l |
| D-mannitol | 15 g/l |
| Glutar aldehyde sulfite adduct | 4.0 g/l |

Developer starter:

To glacial acetic acid of 210 g and KBr of 530 g was added water to make 1 liter.

Using the prepared fixing replenisher tablets was prepared a fixing solution having the following composition, as a fixer starting solution.

Fixer starting solution:

| | |
|---|---|
| Ammonium thiosulfate | 160 g/l |
| Sodium sulfite | 12.0 g/l |
| Boric acid | 1.0 g/l |
| Sodium hydroxide | 5.0 g/l |
| Glacial acetic acid | 10.0 g/l |
| Aluminum sulfate.octadecahydride | 35.0 g/l |
| Sulfuric acid (50 wt %) | 5.0 g/l |
| Disodium ethylenediaminetetraacetate.dihydride | 0.02 g/l |

Evaluation of silver image tone:

Photographic film samples each were sandwiched between two fluorescent intensifying screens (SRO-250), subjected to X-ray exposure that gave a density of 1.2±0.5, and processed with processing solutions described above using an automatic processor, SRX-502, according to the following process. Processed samples were visually evaluated based on the following criteria.

The replenishing rate of the developing and fixing solutions, each was 90 ml/m$^2$.

| Processing condition | | |
|---|---|---|
| Developing | 35° C. | 6.6 sec. |
| Fixing | 33° C. | 4.0 sec. |
| Washing | Ordinary temp. | 3.6 sec. |
| Squeezing | | 1.3 sec. |
| Drying | 40° C. | 4.5 sec. |
| | Total | 20.0 sec. |

Criteria

A: Neutral black

B: Slightly yellowish

C: Yellowish

Evaluation of sharpness

A chest phantom was photographed with each photographic film sample and processed in a manner similar to the method described above. Processed X-ray photograph of the phantom image was evaluated with respect to sharpness, based on the following criteria.

Criteria:

A: Excellent

B: Superior

C: Good

D: Slightly poor

E: Poor

Results thereof are shown in Table 2.

TABLE 2

| Sample | Emulsion | Leuco compd. (mg/m$^2$) | Silver image tone | sharpness | Remark |
|---|---|---|---|---|---|
| 1 | Em-1 | — | C | E | Comp. |
| 2 | do | 8 (20) | B | D | Comp. |
| 3 | do | 9 (20) | B | D | Comp. |
| 4 | Em-2 | — | C | E | Comp. |
| 5 | do | 8 (15) | A | A | Inv. |
| 6 | do | 8 (20) | A | A | Inv. |
| 7 | do | 8 (30) | A | A | Inv. |
| 8 | do | 9 (20) | A | A | Inv. |
| 9 | Em-3 | — | C | E | Comp. |
| 10 | do | 8 (15) | A | A | Inv. |
| 11 | do | 8 (20) | A | A | Inv. |
| 12 | do | 8 (30) | A | A | Inv. |
| 13 | do | 9 (20) | A | A | Inv. |

As can be seen from Table 2, inventive samples 5 to 8 and 10 to 13 each were superior in characteristics and comparative Samples 1 to 4 and 9 were deteriorated in silver image tone and sharpness.

What is claimed is:

1. A silver halide light-sensitive photographic material comprising a support having thereon component layers including a silver halide emulsion layer and a hydrophilic colloid layer, wherein said silver halide emulsion layer contains silver halide grains comprising tabular grains and at least one of the component layers contains a leuco compound capable of forming a dye upon reaction with an oxidation product of a developing agent; said tabular grains 1) having (111) major faces, and exhibiting an average equivalent circular diameter of 0.5 to 3.0 μm and an average thickness of 0.07 to 0.3 μm;

2) including silver halide protrusions epitaxially deposited and having a face-centered cubic crystal lattice structure forming epitaxial junctions with the tabular grains, and 3) said protrusions being located on peripheral portions of the tabular grains and containing 0.1 to 13 mol % iodide wherein said leuco compound is represented by the following formula (1)

formula (1)

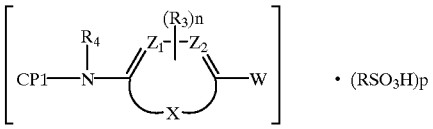

wherein W is —$NR_1R_2$, —OH or —OZ, in which $R_1$ and $R_2$ each are an alkyl group or an aryl group and Z is an alkali metal ion or a quaternary ammonium ion; $R_1$ is a hydrogen atom, a halogen atom or a univalent substituent; n is an integer of 1 to 3; $Z_1$ and $Z_2$ each are a nitrogen atom or =C($R_3$)—; X is an atomic group necessary for forming a 5- or 6-membered aromatic heterocyclic ring; $R_4$ is a hydrogen atom, an acyl group, a sulfonyl group, carbamoyl group, sulfo group, sulfamoyl group, an alkoxycarbonyl group or aryoxycarbonyl group; R is an aliphatic group or an aromatic group; p is an integer of 0, 1 or 2; CP1 is a group represented by the following formulas:

CP1

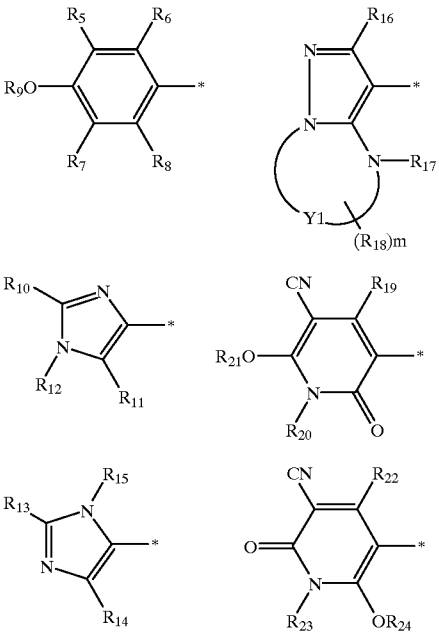

-continued

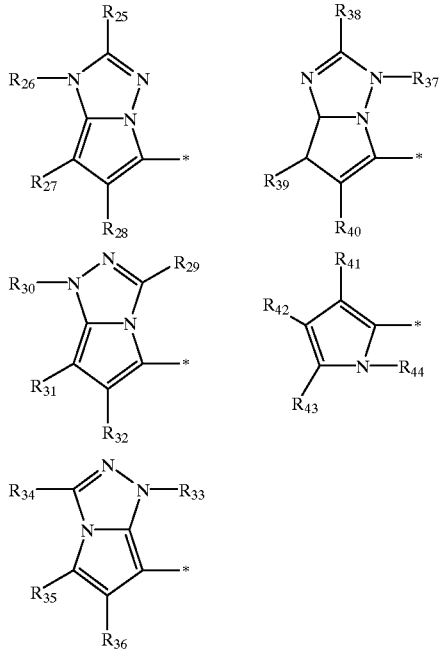

wherein $R_5$ through $R_6$ independently are a hydrogen atom, a halogen atom or a substituent, provided that $R_5$ and $R_6$, or $R_7$ and $R_8$ may form together with each other to form a 5 to 7membered ring; $R_9$ has the same definition as $R_4$; $R_{10}$ and $R_{11}$ independently are an alkyl group, an aryl group or a heterocyclic group; $R_{12}$ has the same definition as $R_4$; $R_{13}$ and $R_{14}$ each have the same definition of $R_{10}$, and $R_{11}$; $R_{15}$ has the same definition as $R_{12}$; $R_{16}$ is an alkyl group, an aryl group, a sulfonyl group, a trifluoromethyl group, a carboxy group, an aryloxycarbonyl group, an alkoxycarbonyl group, a carbamoyl group or a cyano group; $R_{17}$ has the same definition as $R_4$; $R_{18}$ has the same definition as $R_3$; m is an integer of 1 to 3; Y1 is an atomic group necessary for forming 5- or 6-membered nitrogen containing ring; $R_{19}$ and $R_{20}$ independently are an alkyl group or an aryl group; $R_{21}$ has the same definition as $R_4$; $R_{22}$ and $R_{23}$ each have the same definition as $R_{19}$ and $R_{20}$; $R_{24}$ has the same definition as $R_{21}$; $R_{25}$, $R_{27}$ and $R_{28}$ independently are a hydrogen atom or a substituent; $R_{26}$ has the same definition as $R_4$; $R_{29}$, $R_{31}$ and $R_{32}$ each have the same definition as $R_{25}$, $R_{27}$ and $R_{28}$; $R_{30}$ has the same definition as $R_{26}$; $R_{34}$, $R_{35}$ and $R_{36}$ each have the same definition $R_{25}$, $R_{27}$ and $R_{28}$; $R_{33}$ has the same definition as $R_{26}$; $R_{38}$, $R_{39}$ and $R_{40}$ each have the same definition as $R_{25}$, $R_{27}$ and $R_{28}$; $R_{37}$ has the same definition as $R_{26}$; $R_{41}$, $R_{42}$ and $R_{43}$ each have the same definition as $R_{25}$, $R_{27}$ and $R_{28}$; $R_{44}$ has the same definition as $R_{26}$; and the symbol, "★" represents a bonding site of CP1 with the other moiety.

2. The silver halide photographic material of claim 1, wherein said tabular grains contain 0.1 to 10 mol % iodide.

3. The silver halide photographic material of claim 1, wherein said protrusions contain chloride.

4. The silver halide photographic material of claim 1, wherein said protrusions are located predominantly on the peripheral portions.

5. The silver halide photographic material of claim 1, wherein said tabular grains account for at least 50% of the total grain projected area.

6. The silver halide photographic material of claim 1, wherein said leuco compound represented by formula (1) is represented by the following formula (2):

Formula (2)

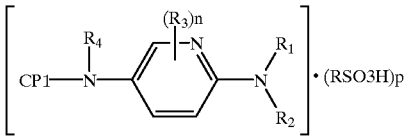

wherein $R_1$, $R_2$, $R_3$ and $R_4$, CP1, n, R and p each have respectively the same definitions as those of $R_1$, $R_2$, $R_3$ and $R_4$, CP1, n, R and p in formula (1).

7. The silver halide photographic material of claim 1, wherein at least one of $R_4$, $R_9$, $R_{12}$, $R_{15}$, $R_{17}$, $R_{21}$, $R_{24}$, $R_{26}$, $R_{30}$, $R_{33}$, $R_{37}$ and $R_{44}$ is substituted by a substituent selected from the group consisting of —$COOM^1$ and —$SO_3M^2$, in which $M^1$ and $M^2$ are each a hydrogen atom or an alkali metal atom.

8. The silver halide photographic material of claim 1, wherein said compound represented by formula (1) is contained in an amount of $1\times10^{-6}$ to $5\times10^{-1}$ mol per mol of silver.

* * * * *